US006762015B2

(12) United States Patent
Nakamura et al.

(10) Patent No.: US 6,762,015 B2
(45) Date of Patent: Jul. 13, 2004

(54) SILVER HALIDE PHOTOGRAPHIC EMULSION AND SILVER HALIDE PHOTOGRAPHIC MATERIAL

(75) Inventors: Tetsuo Nakamura, Kanagawa (JP); Takanori Hioki, Kanagawa (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 09/845,355

(22) Filed: May 1, 2001

(65) Prior Publication Data

US 2002/0012891 A1 Jan. 31, 2002

(30) Foreign Application Priority Data

May 1, 2000 (JP) ..... P. 2000-132280

(51) Int. Cl.[7] ..... G03C 1/12; G03C 1/09

(52) U.S. Cl. ..... 430/574; 430/567; 430/570; 430/572; 430/576; 430/583; 430/584; 430/600; 430/603

(58) Field of Search ..... 430/574, 572, 430/570, 576, 577, 578, 579, 580, 581, 582, 583, 584, 585, 586, 587, 588, 589, 590, 591, 592, 593, 594, 595, 567, 600, 603

(56) References Cited

U.S. PATENT DOCUMENTS

| | | | | | |
|---|---|---|---|---|---|
| 5,308,748 | A | | 5/1994 | Ikegawa et al. | 430/574 |
| 5,310,645 | A | | 5/1994 | Ikegawa et al. | 430/574 |
| 5,364,755 | A | * | 11/1994 | Miyamoto et al. | 430/584 |
| 5,422,238 | A | | 6/1995 | Ikegawa et al. | 430/583 |
| 5,604,089 | A | | 2/1997 | Ikegawa et al. | 430/584 |
| 5,853,968 | A | | 12/1998 | English et al. | 430/506 |
| 6,090,537 | A | | 7/2000 | Nakamura et al. | 430/574 |
| 6,103,461 | A | * | 8/2000 | Hioki et al. | 430/574 |

FOREIGN PATENT DOCUMENTS

| | | | |
|---|---|---|---|
| JP | 5-173277 | 7/1993 | G03C/1/16 |

* cited by examiner

*Primary Examiner*—Thorl Chea
(74) *Attorney, Agent, or Firm*—Sughrue Mion, PLLC

(57) ABSTRACT

A silver halide photographic emulsion which contains at least two sensitizing dyes represented by the following formula (I):

$$\text{Dye-}((A)_r Q)_q (M)_m \qquad (I)$$

wherein Dye represents a dye moiety; A represents a linking group; Q represents a dissociable group; r represents 0 or 1; q represents an integer of 2 or more; provided that at least one Q represents —$SO_3H$ and at least one Q represents a dissociable group other than —$SO_3H$; M represents a counter ion; and m represents a number of 0 or more necessary to neutralize the electric charge in the molecule, and when 2 represents 2 or more, M's need not be the same.

10 Claims, No Drawings

SILVER HALIDE PHOTOGRAPHIC EMULSION AND SILVER HALIDE PHOTOGRAPHIC MATERIAL

FIELD OF THE INVENTION

The present invention relates to a silver halide photographic emulsion and a silver halide photographic material. More specifically, the present invention relates to a silver halide photographic emulsion which is high speed and hardly causes residual color after processing even in rapid processing, and to a silver halide photographic material.

BACKGROUND OF THE INVENTION

A great deal of endeavors have been done to improve sensitivity of a silver halide photographic material and to reduce residual color after processing. The improvements of the sensitivity and the quality of photographic materials have been required more and more on one hand, the demands for shortening of photographic processing speed and the reduction of waste solutions in view of environmental protection have increased on the other hand in particular in recent years, hence the importance of techniques of spectrally sensitizing silver halide grains in high sensitivity without causing harmful influences such as fog and residual color has been increasingly raised.

It is known that the sensitizing dye for use in spectral sensitization gives large influences on the performances of silver halide photographic materials. In the sensitizing dye, a little structural difference largely affects photographic performances such as sensitivity, fog, storage stability and residual color after processing and photographic performances are also largely influenced by using two or more sensitizing dyes in combination, but it is difficult to forecast the effect in advance. Therefore, many researchers have synthesized a large number of sensitizing dyes and endeavored to examine the combined use of a variety of sensitizing dyes and investigate the photographic performances. However, it is the present situation that the photographic performances cannot be forecast yet.

The tabular grain is preferred for use in spectral sensitization in that it is large in the ratio of the surface area to the volume (specific surface area), hence it can absorb a large amount of sensitizing dye, but residual color after processing increases the more. Residual color is observed as fog and the problem of fog is more serious than in regular grains. On the other hand, the main current of the color developing time in color print materials is 180 seconds at present. Further shortening of the processing time is required but if the processing time is shortened, the residual amount of the sensitizing dye used in an emulsion increases and the problem of fog becomes more serious. Therefore, a technique which can reduce the fog attributable to residual color has been desired.

SUMMARY OF THE INVENTION

The objects of the present invention is to provide a silver halide photographic emulsion which is high speed and hardly causes residual color after processing even in rapid processing, and to provide a silver halide photographic material.

As a result of eager investigation of the problems, the present invention has been accomplished by the following means (1) to (12).

(1) A silver halide photographic emulsion which contains at least two sensitizing dyes represented by the following formula (I).

$$\text{Dye-}((A)_r Q)_q (M)_m \qquad \text{(I)}$$

wherein Dye represents a dye moiety; A represents a linking group; Q represents a dissociable group; r represents 0 or 1; q represents an integer of 2 or more, provided that at least one Q represents $—SO_3H$ and at least one Q represents a dissociable group other than $—SO_3H$; M represents a counter ion; and m represents a number of 0 or more necessary to neutralize the electric charge in the molecule, and when m represents 2 or more, M's need not be the same.

(2) The silver halide photographic emulsion as described in the above item (1), wherein the dissociable group other than $—SO_3H$ is selected from the group consisting of —COOH, $—CONHSO_2R$, $—SO_2NHCOR$, $—SO_2NHSO_2R$, —CONHCOR, $—OSO_3H$, $—PO(OH)_2$, $—OPO(OH)_2$, $—B(OH)_2$, $—OB(OH)_2$, —ArOH, and —ArSH, wherein R represents an alkyl group, an aryl group, a heterocyclic group, an alkoxyl group, an aryloxy group, a heterocyclic oxy group, or an amino group, and Ar represents an arylene group.

(3) The silver halide photographic emulsion as described in the above item (1) or (2), wherein the sensitizing dyes are cyanine dyes.

(4) The silver halide photographic emulsion as described in the above item (1), (2) or (3), wherein the sensitizing dyes are represented by the following formula (II):

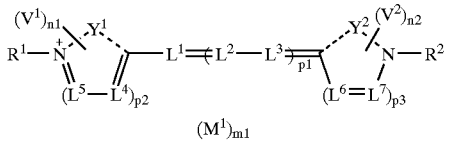

wherein $R^1$ and $R^2$ each represents a substituted alkyl, aryl or heterocyclic group, and $R^1$ is substituted with $—SO_3H$ and $R^2$ is substituted with a dissociable group other than $—SO_3H$; $Y^1$ and $Y^2$ each represents an atomic group necessary to form a 5- or 6-membered nitrogen-containing heterocyclic ring, and $Y^1$ and $Y^2$ may be condensed with other carbocyclic ring or heterocyclic ring; $V^1$ and $V^2$ each represents a substituent; $n^1$ and $n^2$ each represents an integer of 0 or more (preferably 6 or less, more preferably 2 or less), and when $n^1$ and $n^2$ each represents 2 or more, $V^1$ and $V^2$ may be the same with or different from each other; $L^1$, $L^2$, $L^3$, $L^4$, $L^5$, $L^6$ and $L^7$ each represents a methine group; $p^1$ represents 0, 1, 2 or 3, $p^2$ and $p^3$ each represents 0 or 1, and when $p^1$ represents 2 or 3, repeating $L^2$ and $L^3$ may be the same with or different from each other; $M^1$ represents a counter ion; and $m^1$ represents a number of 0 or more necessary to neutralize the electric charge in the molecule.

(5) The silver halide photographic emulsion as described in the above item (1), (2), (3) or (4), wherein at least one sensitizing dye is represented by the following formula (III) and at least one sensitizing dye is represented by formula (IV):

(III)

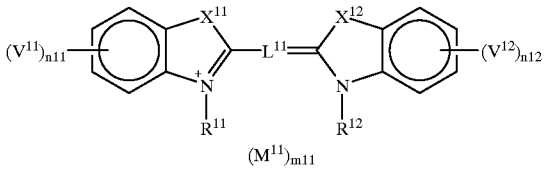

wherein $R^{11}$ and $R^{12}$ each represents a substituted alkyl, aryl or heterocyclic group, and $R^{11}$ is substituted with —$SO_3H$ and $R^{12}$ is substituted with a dissociable group other than —$SO_3H$; $X^{11}$ and $X^{12}$ each represents an oxygen atom, a sulfur atom, a selenium atom, $NR^{15}$, $CR^{16}R^{17}$, or $L^{13}$=$L^{14}$; $R^{15}$, $R^{16}$ and $R^{17}$ each represents a substituted or unsubstituted alkyl, aryl or heterocyclic group; $L^{13}$ and $L^{14}$ each represents a methine group; $V^{11}$ and $V^{12}$ each represents a substituent; $n^{11}$ and $n^{12}$ each represents an integer of 0 or more (preferably 4 or less, more preferably 2 or less), and when $n^{11}$ and $n^{12}$ each represents 2 or more, $V^{11}$ and $V^{12}$ may be the same with or different from each other; $L^{11}$ represents a methine group;$M^{11}$ represents a counter ion; and $m^{11}$ represents a number of 0 or more necessary to neutralize the electric charge in the molecule;

(IV)

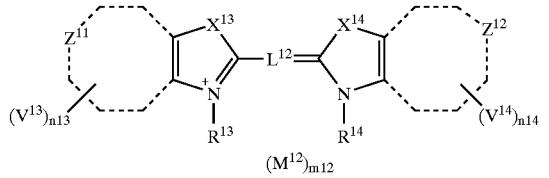

wherein $R^{13}$ and $R^{14}$ each represents a substituted alkyl, aryl or heterocyclic group, and at least one of $R^{13}$ and $R^{14}$ is substituted with —$SO_3H$ and the other is substituted with a dissociable group other than —$SO_3H$; $X^{13}$ and $X^{14}$ each represents an oxygen atom, a sulfur atom, a selenium atom, $NR^{18}$ , $CR^{19}R^{20}$, or $L^{15}$=$L^{16}$; $R^{18}$, $R^{19}$ and $R^{20}$ each represents a substituted or unsubstituted alkyl, aryl or heterocyclic group; $L^{15}$ and $L^{16}$ each represents a methine group; $Z^{11}$ represents a benzene ring or a naphthalene ring; $Z^{12}$ represents a naphthalene ring; $V^{13}$ and $V^{14}$ each represents a substituent; $n^{13}$ and $n^{14}$ each represents an integer of 0 or more ($n^{13}$ represents preferably 4 or less, more preferably 2 or less, and $n^{14}$ epresents preferably 6 or less, more preferably 2 or less), and when $n^{13}$ and $n^{14}$ each represents 2 or more, $V^{13}$ and $V^{14}$ may be the same with or different from each other; $L^{12}$ represents a methine group; $M^{12}$ represents a counter ion; and $m^{12}$ represents a number of 0 or more necessary to neutralize the electric charge in the molecule.

(6) The silver halide photographic emulsion as described in the above item (5), wherein the dissociable group other than —$SO_3H$ is selected from the group consisting of —COOH, —$CONHSO_2R$, —$SO_2NHCOR$, —$SO_2NHSO_2R$, and —CONHCOR, wherein R represents an alkyl group, an aryl group, a heterocyclic group, an alkoxyl group, an aryloxy group, a heterocyclic oxy group, or an amino group.

(7) The silver halide photographic emulsion as described in the above item (1), (2), (3) or (4), wherein at least one sensitizing dye is represented by the following formula (V) and at least one sensitizing dye is represented by formula (VI):

(V)

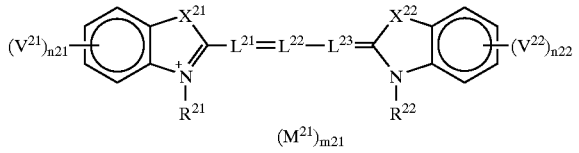

wherein $R^{21}$ and $R^{22}$ each represents a substituted alkyl, aryl or heterocyclic group, and at least one of $R^{21}$ and $R^{22}$ is substituted with —$SO_3H$ and the other is substituted with a dissociable group other than —$SO_3H$; $X^{21}$ and $X^{22}$ each represents an oxygen atom, a sulfur atom, a selenium atom, $NR^{25}$, $CR^{26}R^{27}$, or $L^{27}$=$L^{28}$; $R^{25}$, $R^{26}$ and $R^{27}$ each represents a substituted or unsubstituted alkyl, aryl or heterocyclic group; $L^{27}$ and $L^{28}$ each represents a methine group; $V^{21}$ and $V^{22}$ each represents a substituent; $n^{21}$ and $n^{22}$ each represents an integer of 0 or more (preferably 4 or less, more preferably 2 or less), and when $n^{21}$ and $n^{22}$ each represents 2 or more, $V^{21}$ and $V^{22}$ may be the same with or different from each other; $L^{21}$, $L^{22}$ and $L^{23}$ each represents a methine group; $M^{21}$ represents a counter ion; and $m^{21}$ represents a number of 0 or more necessary to neutralize the electric charge in the molecule;

(VI)

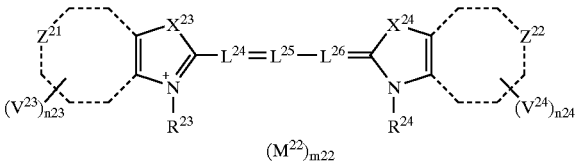

wherein $R^{23}$ and $R^{24}$ each represents a substituted alkyl, aryl or heterocyclic group, and at least one of $R^{23}$ and $R^{24}$ is substituted with —$SO_3H$ and the other is substituted with a dissociable group other than —$SO_3H$; $X^{23}$ and $X^{24}$ each represents an oxygen atom, a sulfur atom, a selenium atom, $NR^{28}$, $CR^{29}R^{30}$, or $L^{29}$=$L^{30}$; $R^{28}$, $R^{29}$ and $R^{30}$ each represents a substituted or unsubstituted alkyl, aryl or heterocyclic group; $L^{29}$ and $L^{30}$ each represents a methine group; $Z^{21}$ represents a benzene ring or a naphthalene ring; $Z^{22}$ represents a naphthalene ring; $V^{23}$ and $V^{24}$ each represents a substituent; $n^{23}$ and $n^{24}$ each represents an integer of 0 or more (when $Z^{21}$ represents a benzene ring, $n^{23}$ represents 4 or less, preferably 2 or less, and when $Z^{21}$ represents a naphthalene ring, $n^{23}$ represents 6 or less, preferably 2 or less, and $n^{24}$ represents 6 or less, preferably 2 or less), and when $n^{23}$ and $n^{24}$ each represents 2 or more, $V^{23}$ and $V^{24}$ may be the same with or different from each other; $L^{24}$, $L^{25}$ and $L^{26}$ each represents a methine group; $M^{22}$ represents a counter ion; and $m^{22}$ represents a number of 0 or more necessary to neutralize the electric charge in the molecule.

(8) The silver halide photographic emulsion as described in the above item (7), wherein the dissociable group other than —$SO_3H$ is selected from the group consisting of —COOH, —$CONHSO_2R$, —$SO_2NHCOR$, —$SO_2NHSO_2R$, and —CONHCOR, wherein R represents an alkyl group, an aryl group, a heterocyclic group, an alkoxyl group, an aryloxy group, a heterocyclic oxy group, or an amino group.

(9) The silver halide photographic emulsion as described in any of the above items (1) to (8), wherein 50% or more of the entire projected area of the silver halide grains in the emulsion is accounted for by tabular grains having an aspect ratio of 2 or more.

(10) The silver halide photographic emulsion as described in any of the above items (1) to (8), wherein the emulsion is chemically sensitized with a selenium sensitizer.

(11) A silver halide photographic material which comprises a support having provided thereon at least one emulsion layer containing the silver halide photographic emulsion described in any of the above items (1) to (10).

DETAILED DESCRIPTION OF THE INVENTION

The sensitizing dye for use in the present invention will be described below.

The sensitizing dye according to the present invention is represented by formula (I).

The dissociable group Q in formula (I) is a group capable of becoming an anionic group by dissociation (e.g., dissociation of proton), i.e., a group capable of having a negative electric charge, e.g., a proton-dissociable acidic group which dissociates 90% or more of protons at pH 5 to 10. Specifically, e.g., a sulfo group (—$SO_3H$), a carboxyl group (—COOH), a sulfato group (—$OSO_3H$), a phosphonic acid group (—$PO(OH)_2$), a phosphoric acid group (—$OPO(OH)_2$), a boronic acid group ($B(OH)_2$), a boric acid group (—$OB(OH)_2$), an amino group substituted with an electron attractive group [e.g., a sulfonylcarbamoyl group (—$CONHSO_2R$), an acylcarbamoyl group (—CONHCOR), an acylsulfamoyl group (—$SO_2NHCOR$), a sulfonylsulfamoyl group (—$SO_2NHSO_2R$), a hydroxyaryl group (—ArOH), and a mercaptoaryl group (—ArSH)] can be exemplified.

In the above formulae, R represents an alkyl group, an aryl group, a heterocyclic group, an alkoxyl group, an aryloxy group, a heterocyclic oxy group, or an amino group, and R preferably represents the following group:

For example, R preferably represents an unsubstituted alkyl group having from 1 to 18, preferably from 1 to 10, and more preferably from 1 to 5, carbon atoms (e.g., methyl, ethyl, propyl, butyl), a substituted alkyl group having from 1 to 18, preferably from 1 to 10, and more preferably from 1 to 5, carbon atoms [e.g., hydroxymethyl, trifluoromethyl, benzyl, carboxyethyl, ethoxycarbonylmethyl, acetylaminomethyl, and an unsaturated hydrocarbon group preferably having from 2 to 18, more preferably from 3 to 10, and most preferably from 3 to 5, carbon atoms (e.g., vinyl, ethynyl, 1-cyclohexenyl, benzylidyne, benzylidene) is also included in a substituted alkyl group], a substituted or unsubstituted aryl group having from 6 to 20, preferably from 6 to 15, and more preferably from 6 to 10, carbon atoms (e.g., phenyl, naphthyl, p-carboxyphenyl, p-nitrophenyl, 3,5-dichlorophenyl, p-cyanophenyl, m-fluorophenyl, p-tolyl), a heterocyclic group having from 1 to 20, preferably from 2 to 10, and more preferably from 4 to 6, carbon atoms, which may be substituted (e.g., pyridyl, 5-methylpyridyl, thienyl, furyl, morpholino, tetrahydrofurfuryl), an alkoxyl group having from 1 to 10, preferably from 1 to 8, carbon atoms (e.g., methoxy, ethoxy, 2-methoxyethoxy, 2-hydroxyethoxy, 2-phenylethoxy), an aryloxy group having from 6 to 20, preferably from 6 to 12, and more preferably from 6 to 10, carbon atoms (e.g., phenoxy, p-methylphenoxy, p-chlorophenoxy, naphthoxy), a heterocyclic oxy group having from 1 to 20, preferably from 3 to 12, and more preferably from 3 to 10, carbon atoms (which group means an oxy group substituted with a heterocyclic group, e.g., 2-thienyloxy, 2-morpholinoxy), or an amino group having from 0 to 20, preferably from 0 to 12, and more preferably from 0 to 8, carbon atoms (e.g., amino, methylamino, dimethylamino, ethylamino, diethylamino, hydroxyethylamino, benzylamino, anilino, diphenylamino, cyclized morpholino, pyrrolidino). These groups may further be substituted with V described later.

R more preferably represents a methyl group, an ethyl group, or a hydroxyethyl group, and particularly preferably a methyl group.

In the above formulae, Ar represents an arylene group. The arylene groups are preferably o-phenylene, m-phenylene, p-phenylene, 4,4'-biphenylene, 1,2-naphthylene, 1,4-naphthylene, and 1,8-naphthylene, more preferably o-phenylene, m-phenylene, and p-phenylene, and especially preferably p-phenylene.

The dissociable groups in the formulae are described in a non-dissociating type (e.g., NH, $CO_2H$), but they can also be described in dissociated form (e.g., $N^-$, $CO_2^-$).

When a cation as the counter salt is present, it is described as (e.g., $N^-$, $Na^+$). In non-dissociated state, it is described as (NH), but regarding a cationic compound of the counter salt as a proton, it can also be described as ($N^-$, $H^+$).

A dissociable group practically becomes a dissociating state or a non-dissociating state depending upon the atmosphere such as pH in which the dye is present.

In formula (I), A represents a linking group (preferably a divalent linking group). The linking group is preferably comprised of an atom or an atomic group containing at least one of a carbon atom, a nitrogen atom, a sulfur atom and an oxygen atom. The linking group is preferably a linking group having from 0 to 100, preferably from 1 to 20, carbon atoms comprised of one or morein combination of an alkylene group (e.g., methylene, ethylene, ethylidene, propylene, trimethylene, butylene, tetramethylene, pentylene), an arylene group (e.g., phenylene, naphthylene), an alkenylene (e.g., ethenylene, propenylene), an alkynylene (e.g., ethynylene, propynylene, which may be branched), an amido group, an ester group, a sulfonamido group, a sulfonic acid ester group, a ureido group, a sulfonyl group, a sulfinyl group, a thioether group, an ether group, a carbonyl group, —$N(V_a)$— (wherein $V_a$ represents a hydrogen atom or a monovalent substituent, and the later-described V can be exemplified as the monovalent substituent), and a heterocyclic divalent group (e.g., a 6-chloro-1,3,5-triazine-2,4-diyl group, a pyrimidine-2,4-diyl group, a quinoxaline-2,3-diyl group).

The linking group may have a substituent represented by V described later, may contain a ring (e.g., an aromatic or a non-aromatic hydrocarbon ring, or a heterocyclic ring), or may be branched.

The linking group is more preferably a divalent linking group having from 1 to 10 carbon atoms comprised of one or more in combination of an alkylene group having from 1 to 10 carbon atoms (e.g., methylene, ethylene, propylene, butylene), an arylene group having from 6 to 10 carbon atoms (e.g., phenylene, naphthylene), an alkenylene having from 2 to 10 carbon atoms (e.g., ethenylene, propenylene), an alkynylene having from 2 to 10 carbon atoms (e.g., ethynylene, propynylene), an ether group, an amido group, an ester group, a sulfonamido group, and a sulfonic acid ester group. The linking group may be substituted with V described later.

The substituent [$(A)_rQ$] having a dissociable group in the dye represented by formula (I) specifically represents a carboxyalkyl group (e.g., carboxymethyl, 2-carboxyethyl, 3-carboxypropyl, 4-carboxybutyl), a sulfoalkyl group (e.g., 2-sulfoethyl, 3-sulfopropyl, 3-sulfobutyl, 4-sulfobutyl, 2-(3-sulfopropoxy)ethyl, 2-hydroxy-3-sulfopropyl, 3-sulfopropoxyethoxyethyl), a sulfoalkenyl group, a sulfatoalkyl group (e.g., 2-sulfatoethyl, 3-sulfatopropyl, 4-sulfatobutyl), an alkylsulfonylcarbamoylalkyl group (e.g., methanesulfonylcarbamoylmethyl), an acylcarbamoylalkyl group (e.g., acetylcarbamoylmethyl), an acylsulfamoylalkyl group (e.g., acetylsulfamoylmethyl), or an alkylsulfonylsulfamoylalkyl group (e.g., methanesulfonylsulfamoylmethyl).

In formula (I), q represents the number of the substituent $[(A)_rQ]$ having a dissociable group, generally an integer of 1 or more, preferably 2 or more (more preferably 4 or less, still more preferably 2 or less, and especially preferably 2), and when q represents 2 or more, a plurality of $[(A)_rQ]$'s may be the same with or different from each other.

Dissociable group Q may be substituted directly on the dye moiety when r represents 0 or may be substituted on the side chain when r represents 1, preferably substituted on the side chain, and it is particularly preferred to have dissociable group Q on the substituent of the N-position of a basic nucleus.

The sensitizing dye according to the present invention comprises at least one dissociable group other than $—SO_3H$, preferably comprises at least one dissociable group other than $—SO_3H$ and at least one $—SO_3H$. The dissociable group other than $—SO_3H$ is preferably —COOH, $—OSO_3H$, $—CONHSO_2R$, —CONHCOR, $—SO_2NHCOR$ or $—SO_2NHSO_2R$, and particularly preferably —COOH or $—CONHSO_2R$.

M in formula (I) is included in the formula to show the presence of a cation or an anion when a counter ion is necessary to neutralize an ionic charge of the dye. Whether a dye is a cation or an anion, or whether a dye has a net ionic charge or not depends upon the substituent thereof. Representative examples of cations include inorganic cations such as a hydrogen ion ($H^+$), an alkali metal ion (e.g., a sodium ion, a potassium ion, a lithium ion), and an alkaline earth metal ion (e.g., a calcium ion), and organic ions such as an ammonium ion (e.g., an ammonium ion, a tetraalkylammonium ion, a triethylammonium ion, a pyridinium ion, an ethylpyridinium ion, a 1,8-diazabicyclo[5.4.0]-7-undeceniumion). Anions may be either inorganic or organic, and examples thereof include a halide anion (e.g., a fluoride ion, a chloride ion, a bromide ion, an iodide ion), a substituted aryl sulfonate ion (e.g., a p-toluenesulfonate ion, a p-chlorobenzenesulfonate ion), an aryldisulfonate ion (e.g., a 1,3-benzenedisulfonate ion, a 1,5-naphthalenedisulfonate ion, a 2,6-naphthalenedisulfonate ion), an alkylsulfate ion (e.g., a methylsulfate ion), a sulfate ion, a thiocyanate ion, a perchlorate ion, a tetrafluoroborate ion, a picrate ion, an acetate ion, and a trifluoromethanesulfonate ion. In addition, ionic polymers or other dyes having a counter charge to the dye may be used.

Preferred cations are a sodium ion, a potassium ion, a triethylammonium ion, a tetraethylammonium ion, a pyridinium ion, an ethylpyridinium ion, and a methylpyridinium ion. Preferred anions are a perchlorate ion, an iodide ion, a bromide ion, and a substituted arylsulfonate ion (e.g., a p-toluenesulfonate ion).

m represents a number of 0 or more necessary to balance the electric charge in the molecule, and m represents 0 when an inner salt is formed. Preferably m represents a number of from 0 to 4.

In formula (I), it is possible to use any dye in the dye moiety Dye.

For example, a cyanine dye, a styryl dye, a hemicyanine dye, a merocyanine dye, a trinuclear merocyanine dye, a tetranuclearmerocyanine dye, a rhodacyanine dye, a complex cyanine dye, a complex merocyanine dye, an allopolar dye, an oxonol dye, a hemioxonol dye, a squarylium dye, a croconium dye, an azamethine dye, a coumarin dye, an arylidene dye, an anthraquinone dye, a triphenylmethane dye, an azo dye, an azomethine dye, a spiro compound, a metallocene dye, a fluorenone dye, a fulgide dye, a perylene dye, a phenazine dye, a phenothiazine dye, a quinone dye, an indigo dye, a diphenylmethane dye, a polyene dye, an acridine dye, an acridinone dye, a diphenylamine dye, a quinacridone dye, a quinophthalone dye, a phenoxazine dye, a phthaloperylene dye, a porphyrin dye, a chlorophyll dye, a phthalocyanine dye, and a metallic complex dye can be exemplified.

Preferred examples of these are polymethine chromophores such as a cyanine dye, a styryl dye, a hemicyanine dye, a merocyanine dye, a trinuclear merocyanine dye (as the basic skeleton of a the merocyanine dye, the basic skeletons represented by formulae (I) and (II) disclosed in JP-A-3-171135 (the term "JP-A" as used herein means an "unexamined published Japanese patent application") and the basic skeletons represented by formula (I) disclosed in JP-A-7-159920 are preferred), a tetranuclear merocyanine dye, a rhodacyanine dye, a complex cyanine dye, a complex merocyanine dye, an allopolar dye, an oxonol dye, a hemioxonol dye, a squarylium dye, a croconium dye, and an azamethine dye, more preferred are a cyanine dye, a merocyanine dye, a trinuclear merocyanine dye, a tetranuclear merocyanine dye, and a rhodacyanine dye, particularly preferred are a cyanine dye and a merocyanine dye, and most preferred is a cyanine dye.

These dyes are described in detail in F. M. Harmer, *Heterocyclic Compounds—Cyanine Dyes and Related Compounds*, John Wiley & Sons, New York, London (1964), D. M. Sturmer, *Heterocyclic Compounds—Special Topics in Heterocyclic Chemistry*, Chap. 18, Clause 14, pp. 482 to 515.

The formulae disclosed on columns from 32 to 36 in U.S. Pat. No. 5,994,051 and the formulae disclosed on columns from 30 to 34 in U.S. Pat. No. 5,747,236 can be exemplified as the formulae of the preferred dyes. Formulae (XI), (XII) and (XIII) disclosed on columns 21 and 22 in U.S. Pat. No. 5,340,694 are preferred as the formulae of a cyanine dye, a merocyanine dye and a rhodacyanine dye, respectively. However, the numbers of $n_{12}$, $n_{15}$, $n_{17}$ and $n_{18}$ are not limited, and they may be an integer of 0 or more (preferably 4 or less).

The sensitizing dye for use in the present invention will be described in further detail below.

The sensitizing dye represented by formula (I) is more preferably represented by formula (II), (VII) or (VIII):

(II)

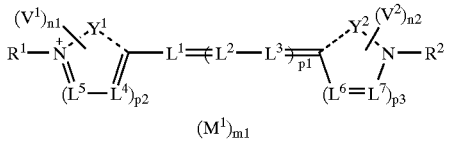

wherein $R^1$ and $R^2$ each represents a substituted alkyl, aryl or heterocyclic group, and $R^1$ is substituted with $—SO_3H$ and $R^2$ is substituted with a dissociable group other than $—SO_3H$; $Y^1$ and $Y^2$ each represents an atomic group necessary to form a 5- or 6-membered nitrogen-containing heterocyclic ring, and $Y^1$ and $Y^2$ may be condensed with other carbocyclic ring or heterocyclic ring; $V^1$ and $V^2$ each represents a substituent; $n^1$ and $n^2$ each represents an integer of 0 or more (preferably 6 or less, more preferably 2 or less), and when $n^1$ and $n^2$ each represents 2 or more, $V^1$ and $V^2$ may be the same with or different from each other; $L^1$, $L^2$, $L^3$, $L^4$, $L^5$, $L^6$ and $L^7$ each represents a methine group; $p^1$ represents 0, 1, 2 or 3, $p^2$ and $p^3$ each represents 0 or 1, and when $p^1$ represents 2 or 3, repeating $L^2$ and $L^3$ may be the same with or different from each other; $M^1$ represents a counter ion; and $m^1$ represents a number of 0 or more necessary to neutralize the electric charge in the molecule;

(VII)

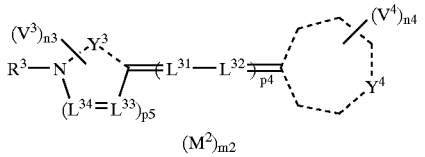

wherein $R^3$ represents a substituted or unsubstituted alkyl, aryl or heterocyclic group, which is substituted with a dissociable group other than —$SO_3H$; $Y^3$ represents an atomic group necessary to form a 5- or 6-membered nitrogen-containing heterocyclic ring, and $Y^3$ may be condensed with other carbocyclic ring or heterocyclic ring; $Y^4$ represents an atomic group necessary to form an acidic nucleus and $Y^4$ may be condensed with other carbocyclic ring or heterocyclic ring; $V^3$ and $V^4$ each represents a substituent; $n^3$ and $n^4$ each represents an integer of 0 or more, and when $n^3$ and $n^4$ each represents 2 or more, $V^3$ and $V^4$ may be the same with or different from each other, $n^3$ preferably represents 6 or less, more preferably 2 or less, and $n^4$ preferably represents 2 or less; $L^{31}$, $L^{32}$, $L^{33}$ and $L^{34}$ each represents a methine group; $p^4$ represents 0, 1, 2 or 3, $p^5$ represents 0 or 1, and when $p^4$ represents 2 or 3, repeating $L^{31}$ and $L^{32}$ may be the same with or different from each other; $M^2$ represents a counter ion; and $m^2$ represents a number of 0 or more necessary to neutralize the electric charge in the molecule;

(VIII)

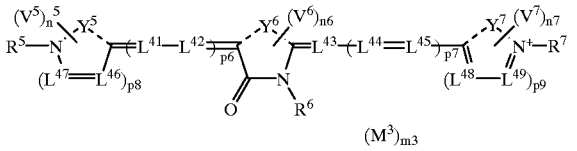

wherein $R^5$, $R^6$ and $R^7$ each represents a substituted or unsubstituted alkyl, aryl or heterocyclic group, and at least one of $R^5$, $R^6$ and $R^7$ is substituted with a dissociable group other than —$SO_3H$; $Y^5$, $Y^6$ and $Y^7$ each represents an atomic group necessary to form a 5- or 6-membered nitrogen-containing heterocyclic ring, and $Y^5$, $Y^6$ and $Y^7$ may be condensed with other carbocyclic ring or heterocyclic ring; $V^5$, $V^6$ and $V^7$ each represents a substituent; $n^5$, $n^6$ and $n^7$ each represents an integer of 0 or more, and when $n^5$, $n^6$ and $n^7$ each represents 2 or more, $V^5$, $V^6$ and $V^7$ may be the same with or different from each other, $n^5$ and $n^7$ each preferably represents 6 or less, more preferably 2 or less, and $n^6$ preferably represents 1 or less, more preferably 0; $L^{41}$, $L^{42}$, $L^{43}$, $L^{44}$, $L^{45}$, $L^{46}$, $L^{47}$, $L^{48}$ and $L^{49}$ each represents a methine group; $p^6$ and $p^7$ each represents 0, 1, 2 or 3, $p^8$ and $p^9$ each represents 0 or 1, and when $p^6$ and $p^7$ each represents 2 or 3, repeating $L^{41}$, $L^{42}$, $L^{44}$ and $L^{45}$ may be the same with or different from each other; $M^3$ represents a counter ion; and $m^3$ represents a number of 0 or more necessary to neutralize the electric charge in the molecule.

In formulae (II), (VII) and (VIII), $Y^1$, $Y^2$, $Y^3$, $Y^5$ and $Y^7$ each represents an atomic group necessary to form a 5- or 6-membered nitrogen-containing heterocyclic ring, and each group may be condensed with a carbocyclic ring or a heterocyclic ring, and the condensed ring may be an aromatic ring or a non-aromatic ring. Preferred rings are an aromatic ring, such as an aromatic hydrocarbon ring, e.g., a benzene ring and a naphthalene ring, and an aromatic heterocyclic ring, e.g., a pyrazine ring and a thiophene ring.

The examples of the above-described 5- or 6-membered nitrogen-containing heterocyclic rings include a thiazoline nucleus, a thiazole nucleus, a benzothiazole nucleus, an oxazoline nucleus, an oxazole nucleus, a benzoxazole nucleus, a selenazoline nucleus, a selenazole nucleus, a benzoselenazole nucleus, a 3,3-dialkylindolenine nucleus (e.g., 3,3-dimethylindolenine), an imidazoline nucleus, an imidazole nucleus, a benzimidazole nucleus, a 2-pyridine nucleus, a 4-pyridine nucleus, a 2-quinoline nucleus, 4-quinoline nucleus, a 1-isoquinoline nucleus, a 3-isoquinoline nucleus, an imidazo[4,5-b]quinoxaline nucleus, an oxadiazole nucleus, a thiadiazole nucleus, a tetrazole nucleus, and a pyrimidine nucleus. Preferred of them are a benzothiazole nucleus, a benzoxazole nucleus, a 3,3-dialkylindolenine nucleus (e.g., 3,3-dimethylindolenine), a benzimidazole nucleus, a 2-pyridine nucleus, a 4-pyridine nucleus, a 2-quinoline nucleus, 4-quinoline nucleus, a 1-isoquinoline nucleus, and a 3-isoquinoline nucleus, more preferred are a benzothiazole nucleus, a benzoxazole nucleus, a 3,3-dialkylindolenine nucleus (e.g., 3,3-dimethylindolenine), and a benzimidazole nucleus, still more preferred are a benzoxazole nucleus, a benzothiazole nucleus, and a benzimidazole nucleus, and particularly preferred are a benzoxazole nucleus and a benzothiazole nucleus.

In formula (VII), $Y^4$ represents an atomic group necessary to form an acyclic or cyclic acidic nucleus, and any form of acidic nucleus of general merocyanine dyes can be used. Preferably, a thiocarbonyl group or a carbonyl group is next to the linking position of the methine chain of $Y^4$.

An acidic nucleus used in the present invention is defined, e.g., by T. H. James, *The Theory of the Photographic Process,* 4th Ed., p. 198, Macmillan Publishing Co. (1977). Specifically, those disclosed in U.S. Pat. Nos. 3,567,719, 3,575,869, 3,804,634, 3,837,862, 4,002,480, 4,925,777 and JP-A-3-167546 can be exemplified.

When an acidic nucleus forms a 5- or 6-membered nitrogen-containing heterocyclic ring comprising carbon, nitrogen and chalcogen (typically, oxygen, sulfur, selenium, tellurium) atoms, the following nuclei are exemplified as preferred examples:

That is, preferred examples of the nuclei include nuclei of 2-pyrazolin-5-one, pyrazolidine-3,5-dione, imidazolin-5-one, hydantoin, 2- or 4-thiohydantoin, 2-iminooxazolidin-4-one, 2-oxazolin-5-one, 2-thiooxazoline-2,4-dione, isooxazolin-5-one, 2-thiazolin-4-one, thiazolidin-4-one, thiazolidine-2,4-dione, rhodanine, thiazolidine-2,4-dithione, isorhodanine, indane-1,3-dione, thiophen-3-one, thiophen-3-one-1,1-dioxide, indolin-2-one, indolin-3-one, 2-oxoindazolinium, 3-oxoindazolinium, 5,7-dioxo-6,7-dihydro-thiazolo[3,2-a]pyrimidine, cyclohexane-1,3-dione, 3,4-dihydroisoquinolin-4-one, 1,3-dioxane-4,6-dione, barbituric acid, 2-thiobarbituric acid, chroman-2,4-dione, indazolin-2-one, pyrido[1,2-a]pyrimidine-1,3-dione, pyrazolo[1,5-b]quinazolone, pyrazolo[1,5-a]benzimidazole, pyrazolopyridone, 1,2,3,4-tetrahydroquinoline-2,4-dione, 3-oxo-2,3-dihydrobenzo[d]thiophene-1,1-dioxide, 3-dicyanomethylene-2,3-dihydrobenzo[d]thiophene-1,1-dioxide, and nuclei having exo-methylene structures obtained by substituting carbonyl groups or thiocarbonyl groups forming these nuclei on the active methylene positions of the active methylene compounds having ketomethylene or cyanomethylene structures.

$Y^4$ are preferably hydantoin, 2- or 4-thiohydantoin, 2-oxazolin-5-one, 2-thiooxazoline-2,4-dione, thiazolidine-2,4-dione, rhodanine, thiazolidine-2,4-dithione, barbituric acid, and 2-thiobarbituric acid, more preferably hydantoin, 2- or 4-thiohydantoin, 2-oxazolin-5-one, rhodanine, barbituric acid, and 2-thiobarbituric acid, and particularly preferably 2- or 4-thiohydantoin, 2-oxazolin-5-one, rhodanine and barbituric acid.

In formula (VIII), the 5- or 6-membered nitrogen-containing heterocyclic ring formed by $Y^6$ is a heterocyclic ring obtained by eliminating an oxo group or a thioxo group from the heterocyclic ring represented by $Y^4$, preferably a heterocyclic ring obtained by eliminating an oxo group or a thioxo group from hydantoin, 2- or 4-thiohydantoin, 2-oxazolin-5-one, 2-thiooxazoline-2,4-dione, thiazolidine-2,4-dione, rhodanine, thiazolidine-2,4-dithione, barbituric acid, or 2-thiobarbituric acid, more preferably a heterocyclic ring obtained by eliminating an oxo group or a thioxo group from hydantoin, 2- or 4-thiohydantoin, 2-oxazolin-5-one, rhodanine, barbituric acid, or 2-thiobarbituric acid, and particularly preferably a heterocyclic ring obtained by eliminating an oxo group or a thioxo group from 2- or 4-thiohydantoin, 2-oxazolin-5-one, or rhodanine.

In formulae (II), (VII) and (VIII), substituents $V^1$ to $V^7$ (they are called generally as "V") on these nitrogen-containing heterocyclic rings $Y^1$ to $Y^7$ are not particularly restricted and, for example, V represents a halogen atom, an alkyl group (including a cycloalkyl group), an alkenyl group (including a cycloalkenyl group), an alkynyl group, an aryl group, a heterocyclic group, a cyano group, a hydroxyl group, a nitro group, a carboxyl group, an alkoxyl group, an aryloxy group, a silyloxy group, a heterocyclic oxy group, an acyloxy group, a carbamoyloxy group, an alkoxycarbonyloxy group, an aryloxycarbonyloxy group, an amino group (including an anilino group), an acylamino group, an aminocarbonylamino group, an alkoxycarbonylamino group, an aryloxycarbonylamino group, a sulfamoylamino group, an alkylsulfonylamino group, an arylsulfonylamino group, a mercapto group, an alkylthio group, an arylthio group, a heterocyclic thio group, a sulfamoyl group, a sulfo group, an alkylsulfinyl group, an arylsulfinyl group, an alkylsulfonyl group, an arylsulfonyl group, an acyl group, an aryloxycarbonyl group, an alkoxycarbonyl group, a carbamoyl group, an arylazo group, heterocyclic azo group, an imido group, a phosphino group, a phosphinyl group, a phosphinyloxy group, a phosphinylamino group, and a silyl group.

More specifically, V represents a halogen atom (e.g., chlorine, bromine, iodine), an alkyl group [a straight chain, branched, cyclic, substituted or unsubstituted alkyl group including an alkyl group (preferably an alkyl group having from 1 to 30 carbon atoms (e.g., methyl, ethyl, n-propyl, isopropyl, t-butyl, n-octyl, eicosyl, 2-chloroethyl, 2-cyanoethyl, 2-ethylhexyl), a cycloalkyl group (preferably a substituted or unsubstituted cycloalkyl group having from 3 to 30 carbon atoms (e.g., cyclohexyl, cyclopentyl, 4-n-dodecylcyclohexyl), a bicycloalkyl group (preferably a substituted or unsubstituted bicycloalkyl group having from 5 to 30 carbon atoms (e.g., bicyclo[1.2.2]heptan-2-yl, bicyclo[2.2.2]octan-3-yl), and a tricyclohexyl structure having many ring structures; the alkyl group in the substituent described below (e.g., the alkyl group in an alkylthio group) includes, in addition to the alkyl group of such a concept, the alkenyl group, the cycloalkenyl group, the bicycloalkenyl group, the alkynyl group, etc., described below], an alkenyl group [a straight chain, branched, cyclic, substituted or unsubstituted alkenyl group including an alkenyl group (preferably a substituted or unsubstituted alkenyl group having from 2 to 30 carbon atoms (e.g., vinyl, allyl, prenyl, geranyl, oleyl), a cycloalkenyl group (preferably a substituted or unsubstituted cycloalkenyl group having from 3 to 30 carbon atoms (e.g., 2-cyclopenten-1-yl, 2-cyclohexen-1-yl), a bicyclo-alkenyl group (a substituted or unsubstituted bicycloalkenyl group, preferably a substituted or unsubstituted bicycloalkenyl group having from 5 to 30 carbon atoms (e.g., bicyclo-[2.2.1]hepto-2-en-1-yl, bicyclo[2.2.2]octo-2-en-4-yl], an alkynyl group [preferably a substituted or unsubstituted alkynyl group having from 2 to 30 carbon atoms (e.g., ethynyl, propargyl, trimethylsilylethynyl)], an aryl group [preferably a substituted or unsubstituted aryl group having from 6 to 30 carbon atoms (e.g., phenyl, p-tolyl, naphthyl, m-chlorophenyl, o-hexadecanoylaminophenyl)], a heterocyclic group [preferably a 5- or 6-membered, substituted or unsubstituted, aromatic or non-aromatic monovalent group obtained by eliminating one hydrogen atom from a heterocyclic compound, more preferably a 5- or 6-membered aromatic heterocyclic group having from 3 to 30 carbon atoms (e.g., 2-furyl, 2-thienyl, 2-pyrimidinyl, 2-benzothiazolyl)], a cyano group, a hydroxyl group, a nitro group, a carboxyl group, an alkoxyl group [preferably a substituted or unsubstituted alkoxyl group having from 1 to 30 carbon atoms (e.g., methoxy, ethoxy, isopropoxy, t-butoxy, n-octyloxy, 2-methoxyethoxy)], an aryloxy group [preferably a substituted or unsubstituted aryloxy group having from 6 to 30 carbon atoms (e.g., phenoxy, 2-methylphenoxy, 4-t-butylphenoxy, 3-nitrophenoxy, 2-tetradecanoylaminophenoxy)], a silyloxy group [preferably a silyloxy group having from 3 to 20 carbon atoms (e.g., trimethylsilyloxy, t-butyldimethylsilyloxy)], a heterocyclic oxy group [preferably a substituted or unsubstituted heterocyclic oxy group having from 2 to 30 carbon atoms (e.g., 1-phenyltetrazol-5-oxy, 2-tetrahydropyranyloxy)], an acyloxy group [preferably a formyloxy group, a substituted or unsubstituted alkylcarbonyloxy group having from 2 to 30 carbon atoms, a substituted or unsubstituted arylcarbonyloxy group having from 6 to 30 carbon atoms (e.g., formyloxy, acetyloxy, pivaloyloxy, stearoyloxy, benzoyloxy, p-methoxyphenylcarbonyloxy)], a carbamoyloxy group [preferably a substituted or unsubstituted carbamoyloxy group having from 1 to 30 carbon atoms (e.g., N,N-dimethylcarbamoyloxy, N,N-diethylcarbamoyloxy, morpholinocarbonyloxy, N,N-di-n-octylaminocarbonyloxy, N-n-octylcarbamoyloxy)], an alkoxycarbonyloxy group [preferably a substituted or unsubstituted alkoxycarbonyloxy group having from 2 to 30 carbon atoms (e.g., methoxycarbonyloxy, ethoxycarbonyloxy, t-butoxycarbonyloxy, n-octylcarbonyloxy)], an aryloxycarbonyloxy group [preferably a substituted or unsubstituted aryloxycarbonyloxy group having from 7 to 30 carbon atoms (e.g., phenoxycarbonyloxy, p-methoxyphenoxycarbonyloxy, p-n-hexadecyloxyphenoxycarbonyloxy)], an amino group [preferably an amino group, a substituted or unsubstituted alkylamino group having from 1 to 30 carbon atoms, a substituted or unsubstituted anilino group having from 6 to 30 carbon atoms (e.g., amino, methylamino, dimethylamino, anilino, N-methylanilino, diphenylamino)], an acylamino group [preferably a formylamino group, a substituted or unsubstituted alkylcarbonylamino group having from 1 to 30 carbon atoms, a substituted or unsubstituted arylcarbonylamino group having from 6 to 30 carbon atoms (e.g., formylamino, acetylamino, pivaloylamino, lauroylamino, benzoylamino, 3,4,5-tri-n-octyloxyphenylcarbonylamino)], an aminocarbonylamino group [preferably a substituted or unsubstituted aminocarbonylamino group having from 1 to 30 carbon atoms (e.g., carbamoylamino, N,N-dimethylaminocarbonylamino, N,N-diethylaminocarbonylamino, morpholinocarbonylamino)], an alkoxycarbonylamino group [preferably a substituted or unsubstituted alkoxycarbonylamino group having from 2 to 30 carbon atoms (e.g., methoxycarbonylamino, ethoxycarbonylamino, t-butoxycarbonylamino, n-octadecyloxycarbonylamino, N-methylmethoxycarbonylamino)], an aryloxycarbonylamino group [preferably a substituted or unsubstituted aryloxycarbonylamino group having from 7 to 30 carbon atoms (e.g., phenoxycarbonylamino, p-chlorophenoxycarbonylamino, m-(n-octyloxyphenoxycarbonylamino)], a sulfamoylamino group [preferably a substituted or unsubstituted sulfamoylamino group having from 0 to 30 carbon atoms (e.g., sulfamoylamino, N,N-dimethylaminosulfonylamino, N-n-octylaminosulfonylamino)], an alkylsulfonylamino group and arylsulfonylamino group [preferably a substituted or unsubstituted alkylsulfonylamino group having from 1 to 30 carbon atoms, a substituted or unsubstituted arylsulfonylamino group having from 6 to 30 carbon atoms (e.g., methylsulfonylamino, butylsulfonylamino, phenylsulfonylamino, 2,3,5-trichlorophenylsulfonylamino, p-methylphenylsulfonylamino)], a mercapto group, an alkylthio group [preferably a substituted or unsubstituted alkylthio group having from 1 to 30 carbon atoms (e.g., methylthio, ethylthio, n-hexadecylthio)], an arylthio group [preferably a substituted or unsubstituted arylthio group having from 6 to 30 carbon atoms (e.g., phenylthio, p-chlorophenylthio, m-methoxyphenylthio)], a heterocyclic thio group [preferably a substituted or unsubstituted heterocyclic thio group having from 2 to 30 carbon atoms (e.g., 2-benzothiazolylthio, 1-phenyltetrazol-5-ylthio)], a sulfamoyl group [preferably a substituted or unsubstituted sulfamoyl group having from 0 to 30 carbon atoms (e.g., N-ethylsulfamoyl, N-(3-dodecyloxypropyl)sulfamoyl, N,N-dimethylsulfamoyl, N-acetylsulfamoyl, N-benzoylsulfamoyl, N-(N'-phenylcarbamoyl)sulfamoyl)], a sulfo group, an alkylsulfinyl group and arylsulfinyl group [preferably a substituted or unsubstituted alkylsulfinyl group having from 1 to 30 carbon atoms, a substituted or unsubstituted arylsulfinyl group having from 6 to 30 carbon atoms (e.g., methylsulfinyl, ethylsulfinyl, phenylsulfinyl, p-methylphenylsulfinyl)], an alkylsulfonyl group and arylsulfonyl group [preferably a substituted or unsubstituted alkylsulfonyl group having from 1 to 30 carbon atoms, a substituted or unsubstituted arylsulfonyl group having from 6 to 30 carbon atoms (e.g., methylsulfonyl, ethylsulfonyl, phenylsulfonyl, p-methylphenylsulfonyl)], an acyl group [preferably a formyl group, a substituted or unsubstituted alkylcarbonyl group having from 2 to 30 carbon atoms, a substituted or unsubstituted arylcarbonyl group having from 7 to 30 carbon atoms, a substituted or unsubstituted heterocyclic carbonyl group having from 4 to 30 carbon atoms bonded to the carbonyl group via a carbon atom (e.g., acetyl, pivaloyl, 2-chloroacetyl, stearoyl, benzoyl, p-n-octyloxyphenylcarbonyl, 2-pyridylcarbonyl, 2-furylcarbonyl)], an aryloxycarbonyl group [preferably a substituted or unsubstituted aryloxycarbonyl group having from 7 to 30 carbon atoms (e.g., phenoxycarbonyl, o-chlorophenoxycarbonyl, m-nitrophenoxycarbonyl, p-t-butylphenoxycarbonyl)], an alkoxycarbonyl group [preferably a substituted or unsubstituted alkoxycarbonyl group having from 2 to 30 carbon atoms (e.g., methoxycarbonyl, ethoxycarbonyl, t-butoxycarbonyl, n-octadecyloxycarbonyl)], a carbamoyl group [preferably a substituted or unsubstituted carbamoyl group having from 1 to 30 carbon atoms (e.g., carbamoyl, N-methylcarbamoyl, N,N-dimethylcarbamoyl, N,N-di-n-octylcarbamoyl, N-(methyl-sulfonyl) carbamoyl)], an arylazo group and heterocyclic azo group [preferably a substituted or unsubstituted arylazo group having from 6 to 30 carbon atoms, a substituted or unsubstituted heterocyclic azo group having from 3 to 30 carbon atoms (e.g., phenylazo, p-chlorophenylazo, 5-ethylthio-1,3,4-thiadiazol-2-ylazo)], an imido group (preferably N-succinimido, N-phthalimido), a phosphino group [preferably a substituted or unsubstituted phosphino group having from 2 to 30 carbon atoms (e.g., dimethylphosphino, diphenylphosphino, methylphenoxyphosphino)], a phosphinyl group [preferably a substituted or unsubstituted phosphinyl group having from 2 to 30 carbon atoms (e.g., phosphinyl, dioctyloxyphosphinyl, diethoxyphosphinyl)], a phosphinyloxy group [preferably a substituted or unsubstituted phosphinyloxy group having from 2 to 30 carbon atoms (e.g., diphenoxyphosphinyloxy, dioctyloxyphosphinyloxy)], a phosphinylamino group [preferably a substituted or unsubstituted phosphinylamino group having from 2 to 30 carbon atoms (e.g., dimethoxyphosphinylamino, dimethylaminophosphinylamino)], a silyl group [preferably a substituted or unsubstituted silyl group having from 3 to 30 carbon atoms (e.g., trimethylsilyl, t-butyldimethylsilyl, phenyldimethylsilyl)], and the above-described groups having a dissociable group represented by Q as are partially duplicated.

Two substituents V's may be linked to each other to form a condensed ring, e.g., a carbocyclic ring such as a benzene ring, a cyclohexene ring, or a naphthalene ring, or a heterocyclic ring such as a pyrazine ring or a thiophene ring, but it is preferred that such a condensed ring is not formed.

Preferred substituents V's are the above-described alkyl group, aryl group, alkoxyl group and halogen atom.

In formula (VII), the alkyl group, aryl group or heterocyclic group bonded to the nitrogen atom contained in the acidic nucleus represented by $Y^4$ is taken as $R^4$, $R^4$, and $R^1$, $R^2$, $R^3$, $R^5$, $R^6$ and $R^7$ in formulae (II), (VII) and (VIII) each represents an alkyl group, an aryl group or a heterocyclic group, specifically, e.g., an unsubstituted alkyl group having from 1 to 18, preferably from 1 to 7, particularly preferably from 1 to 4, carbon atoms (e.g., methyl, ethyl, propyl, isopropyl, butyl, isobutyl, hexyl, octyl, dodecyl, octadecyl), a substituted alkyl group having from 1 to 18, preferably from 1 to 7, and particularly preferably from 1 to 4, carbon atoms [as the example of the substituent, e.g., an alkyl group substituted with V described above can be exemplified, preferably an aralkyl group (e.g., benzyl, 2-phenylethyl), an unsaturated hydrocarbon group (e.g., allyl), a hydroxyalkyl group (e.g., 2-hydroxyethyl, 3-hydroxypropyl), a carboxyalkyl group (e.g., 2-carboxyethyl, 3-carboxypropyl, 4-carboxybutyl, carboxymethyl), an alkoxyalkyl group (e.g., 2-methoxyethyl, 2-(2-methoxyethoxy) ethyl), an aryloxyalkyl group (e.g., 2-phenoxyethyl, 2-(1-naphthoxy)ethyl), an alkoxycarbonylalkyl group (e.g., ethoxycarbonylmethyl, 2-benzyloxycarbonylethyl), an aryloxycarbonylalkyl group (e.g., 3-phenoxycarbonylpropyl), an acyloxyalkyl group (e.g., 2-acetyloxyethyl), an acylalkyl group (e.g., 2-acetylethyl), a carbamoylalkyl group (e.g., 2-morpholinocarbonylethyl), a sulfamoylalkyl group (e.g., N,N-dimethylsulfamoylmethyl), a sulfoalkyl group (e.g., 2-sulfoethyl, 3-sulfopropyl, 3-sulfobutyl, 4-sulfobutyl, 2-(3-sulfopropoxy)ethyl, 2-hydroxy-3-sulfopropyl, 3-sulfopropoxyethoxyethyl), a sulfoalkenyl group, a sulfatoalkyl group (e.g., 2-sulfatoethyl, 3-sulfatopropyl, 4-sulfatobutyl), a heterocyclic group-substituted alkyl group (e.g., 2-(pyrrolidin-2-one-1-yl) -ethyl, tetrahydrofurfuryl), an alkylsulfonylcarbamoylalkyl group (e.g., methanesulfonylcarbamoylmethyl), an acylcarbamoylalkyl group (e.g., acetylcarbamoylmethyl), an acylsulfamoylalkyl group (e.g., acetylsulfamoylmethyl), an alkylsulfonylsulfamoylalkyl group (e.g., methanesulfonylsulfamoylmethyl)], an unsubstituted aryl group having from 6 to 20, preferably from 6 to 10, and more preferably from 6 to 8, carbon atoms (e.g., phenyl, 1-naphthyl), a substituted aryl group having from 6 to 20, preferably from 6 to 10, and more preferably from 6 to 8, carbon atoms (as the example of the substituent, e.g., an aryl group substituted with V described above can be exemplified, specifically, p-methoxyphenyl, p-methylphenyl, p-chlorophenyl), an unsubstituted heterocyclic group having from 1 to 20, preferably from 3 to 10, and more preferably from 4 to 8, carbon atoms (e.g., 2-furyl, 2-thienyl, 2-pyridyl, 3-pyrazolyl, 3-isooxazolyl, 3-isothiazolyl, 2-imidazolyl, 2-oxazolyl, 2-thiazolyl, 2-pyridazyl, 2-pyrimidyl, 3-pyrazyl, 2-(1,3,5-triazolyl), 3-(1,2,4-triazolyl), 5-tetrazolyl), a substituted heterocyclic group having from 1 to 20, preferably from 3 to 10, and more preferably from 4 to 8, carbon atoms (as the example of the substituent, e.g., a heterocyclic group substituted with V described above can be exemplified, specifically, 5-methyl-2-thienyl, 4-methoxy-2-pyridyl) can be exemplified, and the above-described groups having a dissociable group represented by Q as are partially duplicated.

In formulae (II), (VII) and (VIII), $L^1$, $L^2$, $L^3$, $L^4$, $L^5$, $L^6$, $L^7$, $L^{31}$, $L^{32}$, $L^{33}$, $L^{34}$, $L^{41}$, $L^{42}$, $L^{43}$, $L^{44}$, $L^{45}$, $L^{46}$, $L^{47}$, $L^{48}$ and $L^{49}$ each represents a methine group. Each methine group may be substituted, and the above-described V can be exemplified as the substituents, e.g., a substituted or unsubstituted alkyl group having from 1 to 15, preferably from 1 to 10, and particularly preferably from 1 to 5, carbon atoms (e.g., methyl, ethyl, 2-carboxyethyl), a substituted or unsubstituted aryl group having from 6 to 20, preferably from 6 to 15, and more preferably from 6 to 10, carbon atoms (e.g., phenyl, o-carboxyphenyl), a substituted or unsubstituted heterocyclic group having from 3 to 20, preferably from 4 to 15, and more preferably from 6 to 10, carbon atoms (e.g., N,N'-dimethylbarbituric acid), a halogen atom (e.g., fluorine, chlorine, bromine, iodine), an alkoxyl group having from 1 to 15, preferably from 1 to 10, and more preferably from 1 to 5, carbon atoms (e.g., methoxy, ethoxy), an amino group having from 0 to 15, preferably from 2 to 10, and more preferably from 4 to 10, carbon atoms (e.g., methylamino, N,N-dimethylamino, N-methyl-N-phenylamino, N-methylpiperazino), an alkylthio group having from 1 to 15, preferably from 1 to 10, and more preferably from 1 to 5, carbonatoms (e.g., methylthio, ethylthio), and an arylthio group having from 6 to 20, preferably from 6 to 12, and more preferably from 6 to 10, carbon atoms (e.g., phenylthio, p-methylphenylthio) can be exemplified as the examples of the substituents. Each methine group may form a ring together with other methine group, or may form a ring together with $Y^1$ to $Y^7$, $R^1$ to $R^7$, and $V^1$ to $V^7$.

$L^4$, $L^5$, $L^6$, $L^7$, $L^{33}$, $L^{34}$, $L^{46}$, $L^{47}$, $L^{48}$ and $L^{49}$ each preferably represents an unsubstituted methine group.

$p^1$, $p^4$, $p^6$ and $p^7$ each represents 0, 1, 2 or 3, preferably 0, 1 or 2, and more preferably 0 or 1. When $p^1$, $p^4$, $p^6$ and $p^7$ each represents 2 or more, the repeating methine groups need not be the same.

$p^2$, $p^3$, $p^5$, $p^8$ and $p^9$ each represents 0 or 1, preferably 0.

In formulae (II), (VII) and (VIII), $M^1$, $M^2$ and $M^3$ each represents a counter ion, preferably the same as M described above. $m^1$, $m^2$ and $m^3$ each represents a number of 0 or more necessary to neutralize the electric charge in the molecule, and each represents 0 when an inner salt is formed, preferably a number of from 0 to 4.

In the present invention, at least two sensitizing dyes represented by formula (I) are contained in the same emulsion. Two or more sensitizing dyes are preferably selected from the sensitizing dyes represented by formula (II), (VII) or (VIII), and more preferably two or more sensitizing dyes are cyanine dyes represented by formula (II).

Particularly preferably, two or more sensitizing dyes are cyanine dyes having equal number of methine chains.

A particularly preferred combination of two or more sensitizing dyes in the present invention is the combination of a dye represented by formula (III) and a dye represented by formula (IV), or the combination of a dye represented by formula (V) and a dye represented by formula (VI).

A dye represented by formula (III) will be described in detail below.

$R^{11}$ and $R^{12}$ each represents a substituted or unsubstituted alkyl, aryl or heterocyclic group, and specific examples of the groups represented by $R^{11}$ and $R^{12}$ can be preferably selected from the groups exemplified in the description of $R^1$ and $R^2$ in the dye represented by formula (II). However, at least either $R^{11}$ or $R^{12}$ is substituted with a dissociable group other than —$SO_3H$. Specifically, the dissociable groups described in Q of the dye represented by formula (I) above can be exemplified, e.g., preferably —COOH, —$OSO_3H$, —$CONHSO_2R$, —CONHCOR, —$SO_2NHCOR$ or —$SO_2NHSO_2R$ (wherein R represents a methyl group, an ethyl group, or a hydroxyethyl group, particularly preferably a methyl group), and particularly preferably —COOH or —$CONHSO_2R$.

$X^{11}$ and $X^{12}$ each represents an oxygen atom, a sulfur atom, a selenium atom, $NR^{15}$, $CR^{16}R^{17}$, or $L^{13}{=}L^{14}$, wherein $R^{15}$, $R^{16}$ and $R^{17}$ each represents a substituted or unsubstituted alkyl, aryl or heterocyclic group, and the same groups as described in $R^1$ in the dye represented by formula (II) can be exemplified as the specific examples thereof. In the above formula, $L^{13}$ and $L^{14}$ each represents a methine group, and the same groups as described in $L^1$ in the dye represented by formula (II) can be exemplified as the specific examples thereof. $X^{11}$ and $X^{12}$ each preferably represents an oxygen atom, a sulfur atom or a selenium atom, and more preferably an oxygen atom or a sulfur atom.

$V^{11}$ and $V^{12}$ each represents a substituent, $n^{11}$ and $n^{12}$ each represents an integer of 0 or more, and when $n^{11}$ and $n^{12}$ each represents 2 or more, $V^{11}$ and $V^{12}$ may be the same with or different from each other. $n^{11}$ and $n^{12}$ each represents an integer of 4 or less, preferably 2 or less, and more preferably 0 or 1. Specific examples of $V^{11}$ and $V^{12}$ can be preferably selected from the groups exemplified in the description of $V^1$ and $V^2$ in the dye represented by formula (II), and $V^{11}$ and $V^{12}$ each preferably represents an alkyl group, an alkoxyl group or a halogen atom, more preferably a halogen atom, and most preferably a chlorine atom or a bromine atom.

$L^{11}$ represents a methine group. Specific examples of the methine groups can be preferably selected from the groups exemplified in the description of $L^1$ in the dye represented by formula (II), and an unsubstituted methine group is preferred.

$M^{11}$ represents a counter ion, and $m^{11}$ represents a number of 0 or more necessary to neutralize the electric charge in the molecule. Specific examples of $M^{11}$ can be preferably selected from the ions exemplified in the description of M in the dye represented by formula (I). Preferred ions are inorganic or organic cations, more preferred are alkali metal ions or ammonium ions, and sodium ions, potassium ions, triethylammonium ions, or ethylpyridinium ions are particularly preferred.

It is also preferred that $m^{11}$ represents 0 to form an inner salt.

A dye represented by formula (IV) will be described in detail below.

$R^{13}$ and $R^{14}$ each represents a substituted or unsubstituted alkyl, aryl or heterocyclic group, and specific examples of the groups represented by $R^{13}$ and $R^{14}$ can be preferably selected from the groups exemplified in the description of $R^1$ and $R^2$ in the dye represented by formula (II). However, at least either $R^{13}$ or $R^{14}$ is substituted with a dissociable group other than —$SO_3H$. Specifically, the dissociable groups described in Q of the dye represented by formula (I) above can be exemplified, e.g., preferably —COOH, —$OSO_3H$, —$CONHSO_2R$, —CONHCOR, —$SO_2NHCOR$ or —$SO_2NHSO_2R$ (wherein R represents a methyl group, an ethyl group, or a hydroxyethyl group, particularly preferably a methyl group), and particularly preferably —COOH or —$CONHSO_2R$.

$X^{13}$ and $X^{14}$ each represents an oxygen atom, a sulfur atom, a selenium atom, $NR^{18}$, $CR^{19}R^{20}$, or $L^{15}$=$L^{16}$, wherein $R^{18}$, $R^{19}$ and $R^{20}$ each represents a substituted or unsubstituted alkyl, aryl or heterocyclic group, and the same groups as described in $R^1$ in the dye represented by formula (II) can be exemplified as the specific examples thereof. In the above formula, $L^{15}$ and $L^{16}$ each represents a methine group, and the same groups as described in $L^1$ in the dye represented by formula (II) can be exemplified as the specific examples thereof. $X^{13}$ and $X^{14}$ each preferably represents an oxygen atom, a sulfur atom or a selenium atom, and more preferably an oxygen atom or a sulfur atom.

$Z^{11}$ represents a benzene ring or a naphthalene ring, preferably a benzene ring. When $Z^{11}$ and $Z^{12}$ each represents a naphthalene ring, it is preferably a naphtho[1,2-d]azole type condensed ring.

$V^{13}$ and $V^{14}$ each represents a substituent, $n^{13}$ and $n^{14}$ each represents an integer of 0 or more, and when $n^{13}$ and $n^{14}$ each represents 2 or more, $V^{13}$ and $V^{14}$ may be the same with or different from each other. Specific examples of $V^{13}$ and $V^{14}$ can be preferably selected from the groups described in $V^1$ and $V^2$ in the dye represented by formula (II). When $Z^{11}$ represents a benzene ring, $n^{13}$represents 4 or less, preferably 2 or less and more preferably 0 or 1, and $V^{13}$ preferably represents an alkyl group, an alkoxyl group or a halogen atom, more preferably a halogen atom, and most preferably a chlorine atom and a bromine atom. When $Z^{11}$ and $Z^{12}$ represents a naphthalene ring, $n^{13}$ represents 6 or less, preferably 2 or less, more preferably 0 or 1 and particularly preferably 0, and $n^{14}$ preferably represents 6 or less, preferably 2 or less, more preferably 0 or 1 and particularly preferably 0.

$L^{12}$ represents a methine group. Specific examples of the methine groups can be preferably selected from the groups exemplified in the description of $L^1$ in the dye represented by formula (II), and an unsubstituted methine group is preferred.

$M^{12}$ represents a counter ion, and $m^{12}$ represents a number of 0 or more necessary to neutralize the electric charge in the molecule. Specific examples of $M^{12}$ can be preferably selected from the ions exemplified in the description of M in the dye represented by formula (I). Preferred ions are inorganic or organic cations, more preferred are alkali metal ions or ammonium ions, and sodium ions, potassium ions, triethylammonium ions, or ethylpyridinium ions are particularly preferred.

It is also preferred that $m^{12}$ represents 0 to form an inner salt.

A dye represented by formula (V) will be described in detail below.

$R^{21}$ and $R^{22}$ each represents a substituted or unsubstituted alkyl, aryl or heterocyclic group, and specific examples of the groups represented by $R^{21}$ and $R^{22}$ can be preferably selected from the groups exemplified in the description of $R^1$ and $R^2$ in the dye represented by formula (II). However, at least either $R^{21}$ or $R^{22}$ is substituted with a dissociable group other than —$SO_3H$. Specifically, the dissociable groups described in Q of the dye represented by formula (I) above can be exemplified, e.g., preferably —COOH, —$OSO_3H$, —$CONHSO_2R$, —CONHCOR, —$SO_2NHCOR$ or —$SO_2NHSO_2R$ (wherein R represents a methyl group, an ethyl group, or a hydroxyethyl group, particularly preferably a methyl group) and particularly preferably —COOH or —$CONHSO_2R$.

$X^{21}$ and $X^{22}$ each represents an oxygen atom, a sulfur atom, a selenium atom, $NR^{25}$, $CR^{26}R^{27}$, or $L^{27}$=$L^{28}$, wherein $R^{25}$, $R^{26}$ and $R^{27}$ each represents a substituted or unsubstituted alkyl, aryl or heterocyclic group, and the same groups as described in $R^1$ in the dye represented by formula (II) can be exemplified as the specific examples thereof. In the above formula, $L^{27}$ and $L^{28}$ each represents a methine group, and the same groups as described in $L^1$ in the dye represented by formula (II) can be exemplified as the specific examples thereof. $X^{21}$ and $X^{22}$ each preferably represents an oxygen atom, a sulfur atom or a selenium atom, and more preferably an oxygen atom or a sulfur atom.

$V^{21}$ and $V^{22}$ each represents a substituent, $n^{21}$ and $n^{22}$ each represents an integer of 0 or more, and when $n^{21}$ and $n^{22}$ each represents 2 or more, $V^{21}$ and $V^{22}$ may be the same with or different from each other. $n^{21}$ and $n^{22}$ each represents an integer of 4 or less, preferably 2 or less, and more preferably 0 or 1. Specific examples of $V^{21}$ and $V^{22}$ can be preferably selected from the groups exemplified in the description of $V^1$ and $V^2$ in the dye represented by formula (II), and $V^{21}$ and $V^{22}$ each preferably represents an alkyl group, an alkoxyl group or a halogen atom, more preferably a halogen atom, and most preferably a chlorine atom or a bromine atom.

$L^{21}$, $L^{22}$ and $L^{23}$ each represents a methine group. Specific examples of the methine groups can be preferably selected from the groups exemplified in the description of $L^1$ in the dye represented by formula (II). $L^{21}$ and $L^{23}$ each preferably represents an unsubstituted methine group, and $L^{22}$ preferably represents a methine group substituted with an unsubstituted alkyl group, and a methine group substituted with a methyl group or an ethyl group is particularly preferred.

$M^{21}$ represents a counter ion, and $m^{21}$ represents a number of 0 or more necessary to neutralize the electric charge in the molecule. Specific examples of $M^{21}$ can be preferably selected from the ions exemplified in the description of M in the dye represented by formula (I). Preferred ions are inorganic or organic cations, more preferred are alkali metal ions or ammonium ions, and sodium ions, potassium ions, triethylammonium ions, or ethylpyridinium ions are particularly preferred.

It is also preferred that $m^{21}$ represents 0 to form an inner salt.

A dye represented by formula (VI) will be described in detail below.

$R^{23}$ and $R^{24}$ each represents a substituted or unsubstituted alkyl, aryl or heterocyclic group, and specific examples of the groups represented by $R^{23}$ and $R^{24}$ can be preferably selected from the groups exemplified in the description of $R^1$ and $R^2$ in the dye represented by formula (II). However, at least either $R^{23}$ or $R^{24}$ is substituted with a dissociable group other than —$SO_3H$. Specifically, the dissociable groups described in Q of the dye represented by formula (I) above can be exemplified, e.g., preferably —COOH, —$OSO_3H$, —$CONHSO_2R$, —CONHCOR, —$SO_2NHCOR$ or —$SO_2NHSO_2R$ (wherein R represents a methyl group, an ethyl group, or a hydroxyethyl group, particularly preferably a methyl group), and particularly preferably —COOH or —$CONHSO_2R$.

$X^{23}$ and $X^{24}$ each represents an oxygen atom, a sulfur atom, a selenium atom, $NR^{28}$, $CR^{29}R^{30}$ or $L^{29}{=}L^{30}$, wherein $R^{28}$, $R^{29}$ and $R^{30}$ each represents a substituted or unsubstituted alkyl, aryl or heterocyclic group, and the same groups as described in $R^1$ in the dye represented by formula (II) can be exemplified as the specific examples thereof. In the above formula, $L^{29}$ and $L^{30}$ each represents a methine group, and the same groups as described in $L^1$ in the dye represented by formula (II) can be exemplified as the specific examples thereof. $X^{23}$ and $X^{24}$ each preferably represents an oxygen atom, a sulfur atom or a selenium atom, and more preferably an oxygen atom or a sulfur atom.

$Z^{21}$ represents a benzene ring or a naphthalene ring, preferably a benzene ring. When $Z^{21}$ and $Z^{22}$ each represents a naphthalene ring, it is preferably a naphtho[1,2-d]azole type condensed ring.

$V^{23}$ and $V^{24}$ each represents a substituent, $n^{23}$ and $n^{24}$ each represents an integer of 0 or more, and when $n^{23}$ and $n^{24}$ each represents 2 or more, $V^{23}$ and $V^{24}$ may be the same with or different from each other. When $Z^{21}$ represents a benzene ring, $n^{23}$ is an integer of 4 or less, preferably 2 or less, and more preferably 0 or 1, and when $Z^{21}$ represents a naphthalene ring, $n^{23}$ is 6 or less, preferably 2 or less, more preferably 0 or 1, and particularly preferably 0. $n^{24}$ is 6 or less, preferably 2 or less, more preferably 0 or 1, and particularly preferably 0. Specific examples of $V^{23}$ and $V^{24}$ can be preferably selected from the groups exemplified in the description of $V^1$ and $V^2$ in the dye represented by formula (II), and when $Z^{21}$ represents a benzene ring, $V^{23}$ preferably represents an alkyl group, an alkoxyl group or a halogen atom, more preferably a halogen atom and particularly preferably a chlorine atom or a bromine atom.

$L^{24}$, $L^{25}$ and $L^{26}$ each represents a methine group. Specific examples of the methine groups can be preferably selected from the groups exemplified in the description of $L^1$ in the dye represented by formula (II). $L^{24}$ and $L^{26}$ each preferably represents an unsubstituted methine group, and $L^{25}$ preferably represents a methine group substituted with an unsubstituted alkyl group, and a methine group substituted with a methyl group or an ethyl group is particularly preferred.

$M^{22}$ represents a counter ion, and $m^{22}$ represents a number of 0 or more necessary to neutralize the electric charge in the molecule. Specific examples of $M^{22}$ can be preferably selected from the ions exemplified in the description of M in the dye represented by formula (I). Preferred ions are inorganic or organic cations, more preferred are alkali metal ions or ammonium ions, and sodium ions, potassium ions, triethylammonium ions, or ethylpyridinium ions are particularly preferred.

Specific examples of the sensitizing dyes according to the present invention are shown below but it should not be construed as the present invention is limited thereto.

I-1

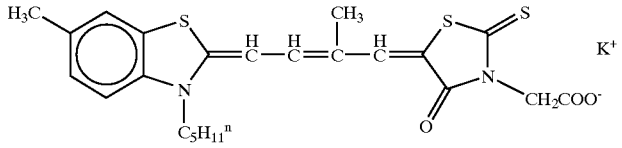

I-2

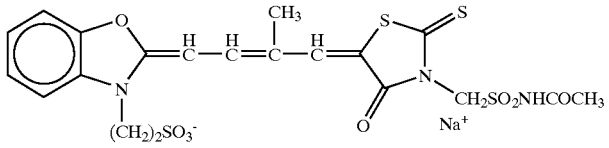

I-3

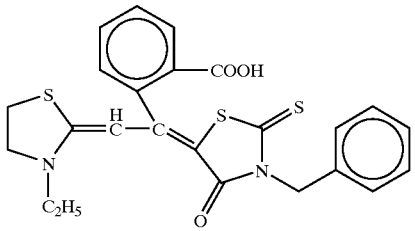

I-4

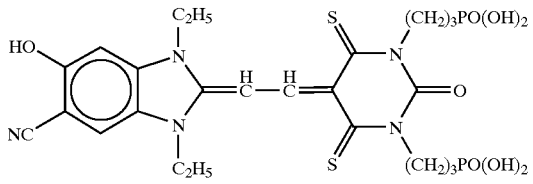

-continued
I-5
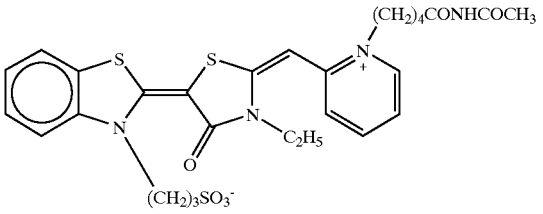
I-6
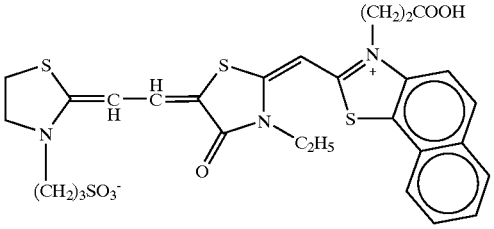
II-1
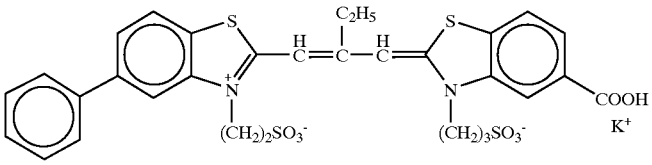
II-2
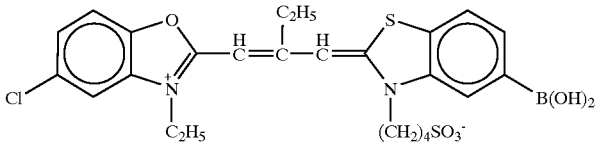
II-3
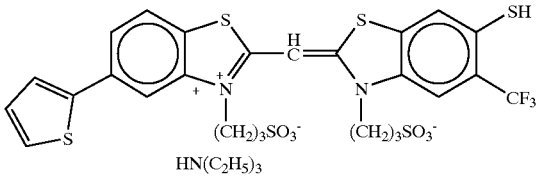
II-4
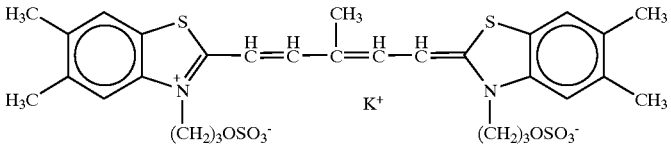
II-5
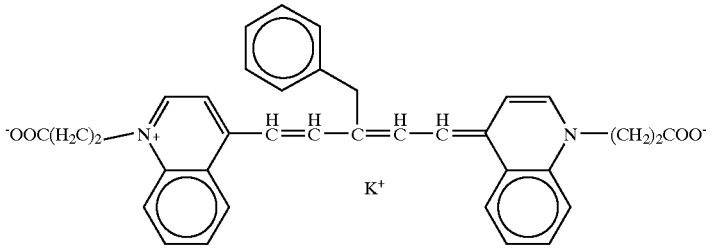
II-6
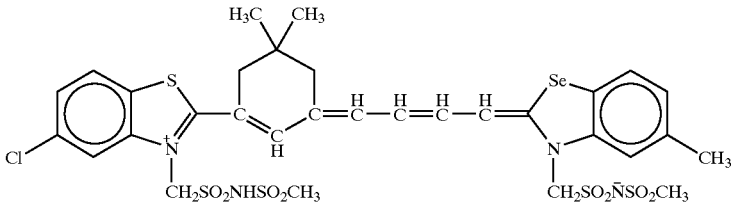

-continued
III-1
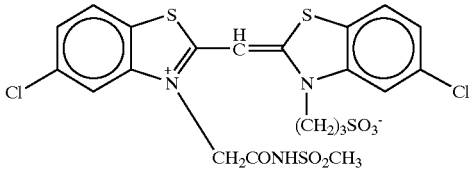
III-2
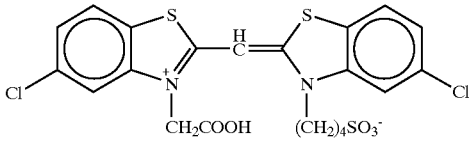
III-3
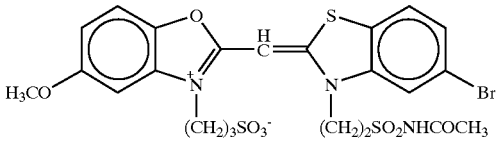
III-4
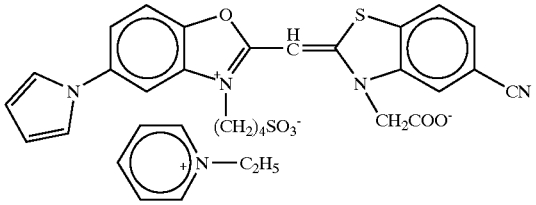
III-5
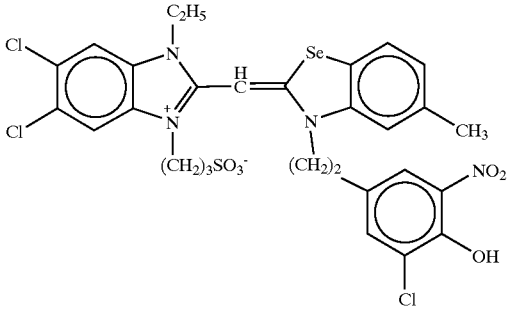
III-6
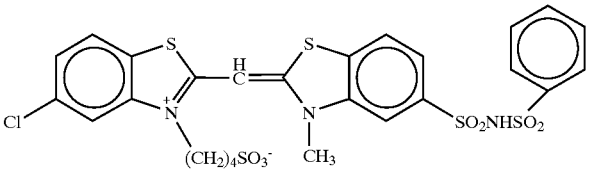
IV-1
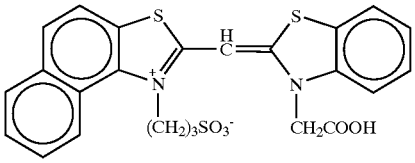
IV-2
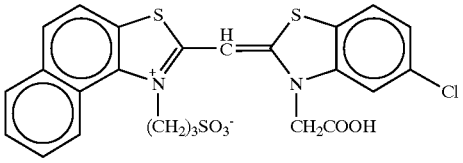

-continued
IV-3
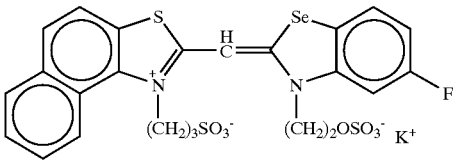
IV-4
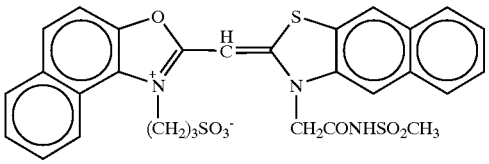
IV-5
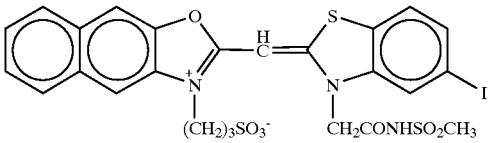
IV-6
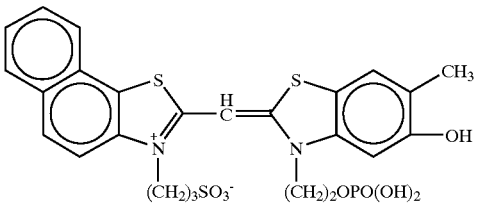
V-1
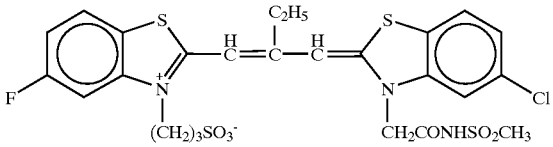
V-2
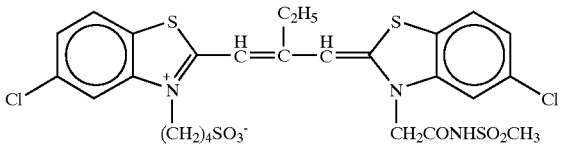
V-3
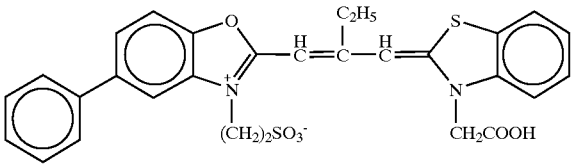
V-4
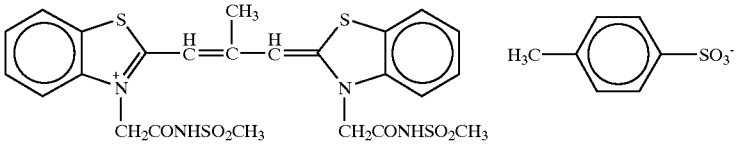
V-5
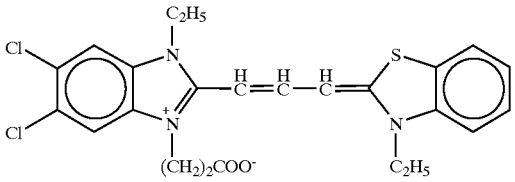

-continued

V-6

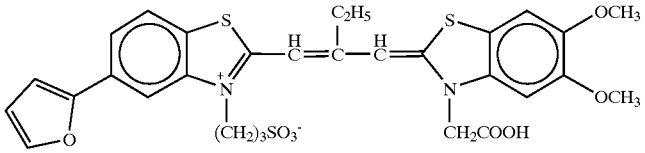

VI-1

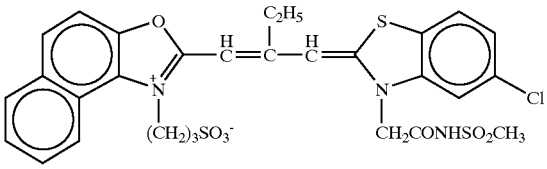

VI-2

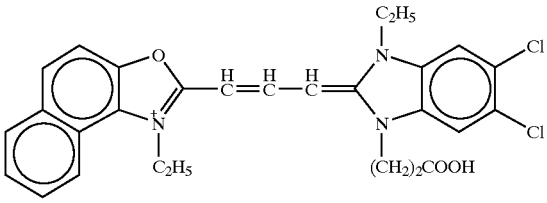

VI-3

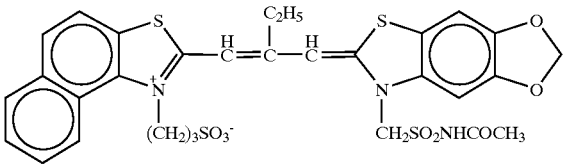

VI-4

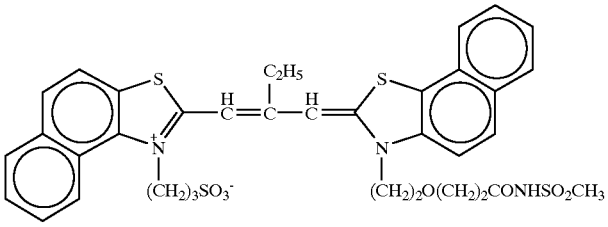

VI-5

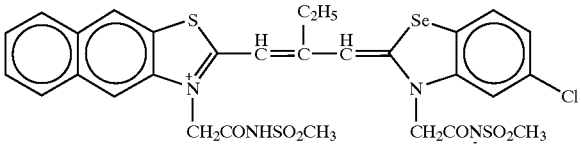

VI-6

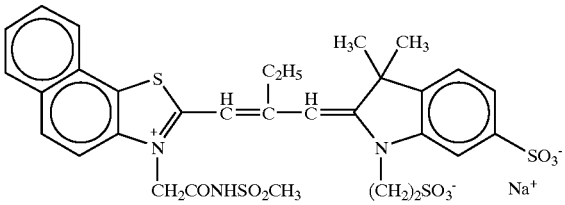

The compound represented by formula (I) (including the dye of the subordinate concept) according to the present invention can be synthesized according to the methods described in F. M. Harmer, *Heterocyclic Compounds—Cyanine Dyes and Related Compounds*, John Wiley & Sons, New York, London (1964), D. M. Sturmer, *Heterocyclic Compounds—Special Topics in Heterocyclic Chemistry*, Chap. 18, Clause 14, pp. 482 to 515, John Wiley & Sons, New York, London (1977), *Rodd's Chemistry of Carbon Compounds,* 2nd Ed., Vol. IV, Part B, Chap. 15, pp. 369 to 422, Elsevier Science Publishing Company Inc., New York (1977) and the like.

The sensitizing dye according to the present invention may be used in combination with other spectral sensitizing dyes except for the point that at least two kinds of dyes are contained in an emulsion.

The silver halide photographic emulsion and the silver halide photographic material according to the present invention are described in detail below.

The time of the addition of the sensitizing dyes (and other sensitizing dyes) for use in the present invention to the silver halide emulsion of the present invention may be at any stage of the preparation of the emulsion recognized as useful hitherto. For example, they may be added at any stage if it is before coating, i.e., during grain formation stage of silver halide grains or/and before desalting stage, during desalting stage and/or after desalting and before beginning of chemical ripening, as disclosed in U.S. Pat. Nos. 2,735,766, 3,628,960, 4,183,756, 4,225,666, JP-A-58-184142 and JP-A-60-196749, or immediately before or during chemical ripening, after chemical ripening and before coating as disclosed in JP-A-58-113920. Also, as disclosed in U.S. Pat. No. 4,225,666 and JP-A-58-7629, the sensitizing dyes can be used as a single compound alone or in combination with compounds having foreign structures, and they can be divided and added separately, for example, one part of them is added during grain formation stage and the remaining is added during chemical ripening or after the completion of chemical ripening, alternatively one part is added prior to chemical ripening or during ripening stage and the remaining after completion of chemical ripening. The kinds of compounds added separately and combinations of compounds may be varied.

The addition amount of the sensitizing dyes for use in the present invention is varied in accordance with the shape and the size of silver halide grains, but the dyes can be used in an amount of from $1\times10^{-6}$ to $8\times10^{-3}$ mol per mol of the silver halide. For example, when the grain size of the silver halide grains is from 0.2 to 1.3 $\mu$m, the addition amount is preferably from $2\times10^{-6}$ to $3.5\times10^{-3}$ mol and more preferably from $7.5\times10^{-6}$ to $1.5\times10^{-3}$ mol per mol of the silver halide.

The sensitizing dyes according to the present invention can be directly dispersed in an emulsion. Alternatively, the dyes may be dissolved in an appropriate solvent, e.g., methyl alcohol, ethyl alcohol, methyl cellosolve, acetone, water, pyridine, or mixtures of these solvents, and added to an emulsion as a solution. At this time, additives such as bases, acids, surfactants, etc., can be added together. Further, ultrasonic waves can also be used for dissolution. For adding the dyes, a method of dissolving the dyes in a volatile organic solvent, dispersing the solution in a hydrophilic colloid and adding this dispersion to an emulsion as disclosed in U.S. Pat. No. 3,469,987, a method of dispersing the dyes in a water-soluble solvent and adding the dispersion to an emulsion as disclosed in JP-B-46-24185 (the term "JP-B" as used herein means an "examined Japanese patent publication"), a method of dissolving the dyes in a surfactant and adding the solution to an emulsion as disclosed in U.S. Pat. No. 3,822,135, a method of dissolving the dyes using a compound capable of red-shifting and adding the solution to an emulsion as disclosed in JP-A-51-74624, a method of dissolving the dyes in an acid not substantially containing water and adding the solution to an emulsion as disclosed in JP-A-50-80826 can be used. Besides the above methods, the methods disclosed in U.S. Pat. Nos. 2,912,343, 3,342,605, 2,996,287 and 3,429,835 can also be used.

For dissolving the sensitizing dye of the present invention, e.g., methyl alcohol, ethyl alcohol, n-propanol, isopropanol, n-butanol, isobutanol, t-butanol, benzyl alcohol, fluorinated alcohol, methyl cellosolve, acetone, pyridine and mixed solvents of these compounds can be used.

It is preferred to add a base to dissolve the sensitizing dye of the present invention in water, the above organic solvents or mixed solvents of these compounds. The base may be organic or inorganic, e.g., amine derivatives (e.g., triethylamine, triethanolamine), pyridine derivatives, sodium hydroxide, potassium hydroxide, sodium acetate, and potassium acetate can be exemplified. As the preferred dissolving method, a method of adding a dye to the mixed solvent of water and methanol, and further adding thereto the equimolar amount of triethylamine with the dye can be exemplified.

Supersensitizers preferably used in spectral sensitization in the present invention are, e.g., pyrimidylamino compounds, triazinylamino compounds, and azolium compounds disclosed in U.S. Pat. Nos. 3,511,664, 3,615,613, 3,615,632, 3,615,641, 4,596,767, 4,945,038, 4,965,182, and 4,965,182, and using methods disclosed in these patents are also preferably used.

Any of silver chloride, silver bromide, silver chlorobromide, silver iodobromide, silver iodochloride, and silver chloroiodobromide can be used as silver halide grains in the silver halide emulsion according to the present invention. For example, it is preferred to use a silver chlorobromide emulsion for a color photographic paper for the purpose of rapid processing and simplification, and silver chloride, silver chlorobromide or silver chloroiodobromide having a silver chloride content of 95 mol % or more can be preferably used as the silver chlorobromide emulsion. In particular, silver chlorobromide or silver chloride substantially free of silver iodide can be preferably used for shortening the development processing time. A silver iodobromide emulsion is preferably used for a color film for photographing (a negative film or a reversal film), and silver bromide, silver iodobromide, or silver chloroiodobromide having a silver bromide content of 95 mol % or more can be used as the silver iodobromide emulsion.

The average grain size (the diameter of the circle equivalent to the projected area of the grain is taken as the grain size, and the average grain size is the number average of grain sizes) of the silver halide grains contained in the silver halide emulsion of the present invention is preferably from 0.1 to 2 $\mu$m or less.

The variation coefficient of the grain size distribution of the grains (the value obtained by dividing the standard deviation of the grain size distribution by the average grain size) is 20% or less, preferably 15% or less, and more preferably 10% or less, which is monodispersed. Blending of monodispersed emulsions for use in the same layer or multilayer coating is preferred for widening the latitude.

The silver halide grains contained in a photographic emulsion may have a regular crystal form, such as cubic, octahedral, or tetradecahedral, an irregular crystal form, such as spherical or plate-like, or a mixture of these crystal forms. It is preferred in the present invention to contain 50% or more, preferably 70% or more, and more preferably 90% or more, of grains having regular crystal forms.

The photographic emulsions for use in the present invention can be prepared according to the methods described in P. Glafkides, *Chimie et Physique Photographique*, Paul Montel (1967), G. F. Duffin, *Photographic Emulsion Chemistry*, Focal Press (1966), and V. L. Zelikman et al., *Making and Coating Photographic Emulsion*, Focal Press (1964) and so on. That is, any of an acid process, a neutral process, and an ammoniacal process may be used for preparing emulsions. Any of a single jet method, a double jet method and a combination of these methods can be used for the reaction of a soluble silver salt with a soluble halogen salt. A method in which grains are formed in the presence of excess silver ions (a so-called reverse mixing method) can also be used. A method in which the pAg in the liquid phase in which the silver halide is formed is kept constant, that is, the controlled double jet method, can also be used as one type of the double jet method. According to this method, a silver halide emulsion having a regular crystal form and nearly uniform grain size can be obtained.

In the emulsion of the present invention, 50% or more, preferably 70% or more, and particularly preferably 80% or more, of the entire projected area of the silver halide grains accounts for tabular grains having an aspect ratio of 2 or more (preferably 100 or less), more preferably from 3 to 50, and particularly preferably from 5 to 30. For example, silver chlorobromide tabular grains are preferably used for a color photographic paper and silver iodobromide tabular grains are preferably used for a general color film for photographing.

In general, a tabular grain is a tabular grain having two parallel planes, accordingly, "the thickness" of a tabular grain means the distance between two parallel planes constituting the tabular silver halide grain. The diameter of a silver halide grain means a diameter of a circle having the same area as the projected area of the grain, and the ratio of the diameter/thickness is called an aspect ratio.

Silver chlorobromide tabular grain for use for color photographic papers preferably has a high silver chloride content of 80 mol % or more, more preferably 95 mol % or more.

Silver chlorobromide tabular grain is preferably comprises a core part and a shell part (an outermost layer) containing more iodide than the core part. The core part may comprises two or more parts having different halogen compositions. The shell part is preferably 50% or less of the entire volume of the grain, particularly preferably 20% or less. The silver iodide content of the shell part is preferably from 0.5 to 13 mol %, particularly preferably from 1 to 6 mol %. The content of silver iodide in the entire grain is preferably from 0.1 to 5 mol %, particularly preferably from 0.1 to 2 mol %. The silver iodide content of the core part is preferably 1 mol % or less, particularly preferably 0%.

The silver bromide content in the core part may differ from that in the shell part. The silver bromide content is preferably from 0 to 20 mol %, particularly preferably from 0.1 to 5 mol %, of the entire silver content.

A high silver chloride content tabular grain preferably has a grain diameter of from 0.2 to 1.0 $\mu$m, a thickness of 0.2 $\mu$m or less, preferably 0.15 $\mu$m or less, and particularly preferably 0.1 $\mu$m or less, and an aspect ratio of from 3 to 20, more preferably from 5 to 15. The grain size distribution of high silver chloride content tabular grains may be polydispersion or polydispersion but is preferably monodispersion. The distribution coefficient of grain size is from 5 to 25%, particularly preferably from 5 to 20%.

The distribution coefficient of grain thickness is from 5 to 25%, particularly preferably from 5 to 15%.

For forming {111} planes as the outer surface of a high silver chloride content tabular grain for use for a color photographic paper, a crystal phase controlling agent (i.e., a crystal habit controlling agent) is used. A tabular grain is formed by generating two twin planes parallel to each other. Since the formation of twin planes is influenced by a dispersion medium (gelatin) and halogen concentration, appropriate conditions must be settled. When a crystal phase controlling agent is present at the time of nucleation, the concentration of gelatin is preferably from 0.1 to10%. A chloride concentration is 0.01 mol/liter or more, preferably 0.03 mol/liter or more.

Specific examples of crystal phase controlling agents and forming methods of {111} high silver chloride tabular grains using a crystal phase controlling agent which can be used in the present invention are disclosed in JP-A-12-29156.

A tabular grain having {100} planes as main planes can also be used in the present invention. The shapes of the main planes are a right angled parallelogrammatic shape, from triangular to pentagonal shapes lacking one corner from the right angled parallelogram (the lacking shape is a right angled triangle part formed by the sides forming the corner with the corner as the vertex), and quadrangular to octagonal shapes having from two to four lacking parts.

Forming methods of tabular silver halide grains having {100} planes as main planes are disclosed, e.g., in JP-A-6-301129, JP-A-6-347929, JP-A-9-34045, JP-9-96881, JP-A-8-122954 and JP-A-9-189977.

Silver iodobromide, silver iodochloride or silver iodochlorobromide containing 30 mol % or less of silver iodide as the halogen composition is preferably used in silver iodobromide tabular grains for color films for photographing. Silver iodobromide or silver iodochlorobromide containing from 2 to 10 mol % of silver iodide is particularly preferably used. Silver chloride may be contained but the content is preferably 8 mol % or less, more preferably 3 mol % or less, most preferably 0 mol %.

A silver iodobromide tabular grain has a diameter of preferably from 0.3 to 5.0 $\mu$m, a thickness of from 0.05 to 0.5 $\mu$m, an aspect ratio of from 3 to 50, more preferably from 4 to 30, and still more preferably from 5 to 25.

The silver halide emulsion for use in the present invention is generally chemically sensitized. As chemical sensitizing methods, a gold sensitizing method using gold compounds (e.g., U.S. Pat. Nos. 2,448,060, 3,320,069), a sensitizing method using metals such as iridium, platinum, rhodium, palladium, etc. (e.g., U.S. Pat. Nos. 2,448,060, 2,566,245, 2,566,263), a sulfur sensitizing method using sulfur-containing compounds (e.g., U.S. Pat. No. 2,222,264), a selenium sensitizing method using selenium compounds, a tellurium sensitizing method using tellurium compound, or a reduction sensitizing method using tin salts, thiourea dioxide, polyamine, etc. (e.g., U.S. Pat. Nos. 2,487,850, 2,518,698, 2,521,925) can be used alone or in combination of two or more.

The silver halide emulsion for use in the present invention is preferably chemically sensitized with selenium sensitizers.

Conventionally well-known selenium compounds can be used in selenium sensitization. That is, in general, selenium sensitization is performed by adding a labile type selenium compound and/or a non-labile type selenium compound to an emulsion and stirring the emulsion for a predetermined period of time at high temperature, preferably at 40° C. or more. Labile type selenium compounds disclosed in JP-B-44-15748, JP-B-43-13489, JP-A-4-25832, and JP-A-4-109240 are preferably sued in the present invention. Specific examples of labile type selenium sensitizers include isoselenocyanates (e.g., aliphatic isoselenocyanates such as allylisoselenocyanate), selenoureas, seleno ketones, selenoamides, selenocarboxylic acids (e.g., 2-selenopropionic acid, 2-selenobutyric acid), seleno esters, diacylselenide (e.g., bis(3-chloro-2,6-dimethoxybenzoyl) selenide), selenophosphates, phosphine selenides and colloidal metallic selenium.

The preferred types of the labile type selenium compound are described above but these are not limitative. The structure of a labile type selenium compound as the sensitizing dye of a photographic emulsion is not particularly important so long as the selenium is labile. It is generally known that the organic moiety of the molecule of a selenium sensitizer carries selenium and has no role but making the selenium present in an emulsion in a labile form. Labile selenium compounds of such a wide concept are advantageously used in the present invention.

The compounds disclosed in JP-B-46-4553, JP-B-52-34492 and JP-B-52-34491 are preferably used as the non-labile type selenium compounds. Examples of the non-labile type selenium compounds include, e.g., selenious acid, potassium selenocyanide, selenazoles, quaternary salts of selenazoles, diaryl selenide, diaryl diselenide, dialkyl selenide, dialkyl diselenide, 2-selenazolidinedione, 2-selenooxazolidinethione, and derivatives thereof.

Of these selenium compounds, those represented by formulae (VII) and (VIII) in JP-A-11-15115 are preferably used.

These selenium sensitizers are dissolved in water, or a single or a mixed solvent of an organic solvent such as methanol and ethanol and added at the time of chemical sensitization, preferably added before the start of chemical sensitization. A selenium sensitizer used is not limited to one kind, and two or more of the above-described selenium sensitizers can be used in combination. Labile selenium compounds and non-labile selenium compounds are preferably used in combination.

The addition amount of a selenium sensitizer for use in the present invention varies depending upon the degree of activity of the selenium sensitizer used, the kind and size of the silver halide used and the temperature and time of ripening, but is preferably $1\times10^{-8}$ mol or more, more preferably from $1\times10^{-7}$ to $5\times10^{-5}$ mol, per mol of the silver halide of the emulsion. The temperature of chemical ripening when a selenium sensitizer is used is preferably 45° C. or more, more preferably from 50° C. to 80° C. pAg and pH are arbitrary. For example, the effect of the present invention can be obtained at a broad pH range of from 4 to 9.

Various kinds of compounds and precursors thereof can be added to the silver halide emulsion according to the present invention for the purpose of preventing fog during the producing stage of a photographic material, storage or photographic processing or for stabilizing photographic performances. Specifically, the compounds disclosed on pages 39 to 72 in JP-A-62-215272 can be preferably used. Further, 5-arylamino-1,2,3,4-thiatriazole compound (the aryl residue has at least one electron attractive group) disclosed in EP 0447647 can be also preferably used.

The silver halide emulsion prepared according to the present invention can be used for both color photographic materials and black-and-white photographic materials. As the color photographic materials, in particular, color photographic papers, color films for photographing and color reversal films, and as black-and-white photographic materials, X-ray films, general films for photographing and photographic films for printing can be exemplified respectively.

With respect to various techniques and inorganic and organic materials which can be used in the silver halide photographic material according to the present invention, in general, those disclosed in *Research Disclosure*, No. 308119 (1989) and ibid., No. 37038 (1955) can be used.

In addition to these, more specifically, for example, techniques and inorganic and organic materials which can be used in the color photographic material to which the silver halide photographic emulsion of the present invention is applicable are summarized in the following places of EP-A-436938 and the patents cited in the following places.

1. Layer Structure line 34, page 146 to line 25, page 147
2. Silver Halide Emulsion line 26, page 147 to line 12, page 148
3. Yellow Couplers line 35, page 137 to line 33, page 146, lines 21 to 23, page 149
4. Magenta Couplers lines 24 to 28, page 149; line 5, page 3 to line 55, page 25 of EP-A-421453
5. Cyan Couplers lines 29 to 33, page 149; line 28, page 3 to line 2, page 40 of EP-A-432804
6. Polymer Couplers lines 34 to 38, page 149; line 39, page 113 to line 37, page 123 of EP-A-435334
7. Colored Couplers line 42, page 53 to line 34, page 137, lines 39 to 45, page 149
8. Other Functional Couplers line 1, page 7 to line 41, page 53, line 46, page 149 to line 3 page 150; line 1, page 3 to line 50, page 29 of EP-A-435334
9. Preservative lines 25 to 28, page 150
10. Formalin Scavengers lines 15 to 17, page 149
11. Other Additives lines 38 to 47, page 153; line 21, page 75 to line 56, page 84 of EP-A-421453
12. Dispersion Methods lines 4 to 24, page 150
13. Supports line 32 to 34, page 150
14. Film Thickness, Physical Properties of Films lines 35 to 49, page 150
15. Color Development Process line 50, page 150 to line 47, page 151
16. Desilvering Process line 48, page 151 to line 53, page 152
17. Automatic Processors line 54, page 152 to line 2, page 153
18. Washing and Stabilizing Processes lines 3 to 37, page 153

EXAMPLES

The present invention will be described in detail below with referring to examples but the present invention is not limited thereto.

Example 1

Preparation of {111} High Silver Chloride Tabular Grains

To 1.2 liters of water were added 2.0 g of sodium chloride and 2.4 g of inert gelatin and the temperature of the reaction vessel was maintained at 33° C. A nitric acid aqueous solution (60 ml, containing 9 g of nitric acid) and 60 ml of a sodium chloride aqueous solution (containing 3.2 g of sodium chloride) were added to the reaction vessel by a double jet method with stirring over 1 minute. One minutes after the completion of addition, 1 mmol of Crystal Phase Controlling Agent-1 was added to the reaction solution. One minute after that, 3.0 g of sodium chloride was added thereto. Then, the temperature of the reaction vessel was raised to 60° C. over 25 minutes. Ripening was performed at 60° C. for 16 minutes, and then 290 g of a 10% aqueous solution of phthalated gelatin and 0.8 mmol of Crystal Phase Controlling Agent-1 were added. Thereafter, 754 ml of a nitric acid aqueous solution (containing 113 g of nitric acid) and 768 ml of a sodium chloride aqueous solution (containing 41.3 g of sodium chloride) were added to the reaction mixture at an accelerated flow rate over 28 minutes. During that time, 30 ml of 0.25 M sodium chloride aqueous solution containing potassium iodide (the addition amount that the iodide content of the outermost layer reached 0.5%), 11 mg of potassium ferrocyanide and $1.5\times10^{-8}$ mol of iridium hexachloride was added to the above solution over 21 to 28 minutes.

After addition was finished, 5.6 ml of 1% potassium thiocyanate and the sensitizing dye shown in Table 1 were added thereto and then the temperature was raised to 75° C. and the stirring was continued for 10 minutes.

The temperature was lowered to 40° C. and desalting processing was performedusing Precipitant-1 according to ordinary flocculation method.

After desalting, 67 g of gelatin, 80 ml of phenol (5%) and 150 ml of distilled water were added to the above mixture. pH and pAg were adjusted to 6.2 and 7.5 respectively using sodium hydroxide and a silver nitrate solution. Thus, Emulsions 101 to 112 were obtained, in which 96% of the entire projected area accounted for tabular grains having an average equivalent-sphere diameter of 0.69 μm, an average equivalent-circle diameter of 1.19 μm, an average thickness of 0.13 μm, and an average aspect ratio of 9.1.

Chemical Sensitization

Emulsions 101 to 112 were optimally chemically sensitized at 60° C. using sodium thiosulfonate, 1-(5-methylureidophenyl)-5-mercaptotetrazole, Selenium Compound-1, sodium thiosulfate and chloroauric acid.

Crystal Phase Controlling Agent-1

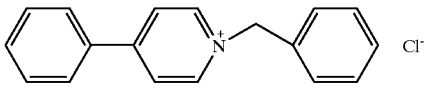

Sen-1

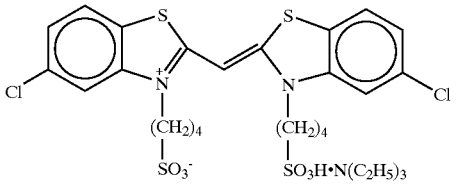

Sen-2

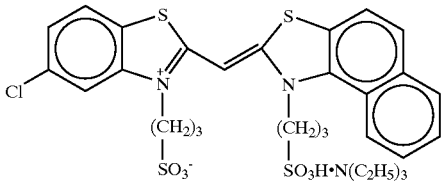

Precipitant-1

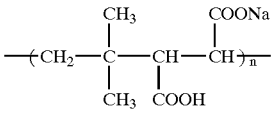

(average molecular weight: 120,000)

Selenium Compound-1

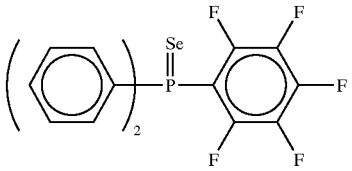

Preparation of Coated Sample

The surface of a paper support both surfaces of which were laminated with polyethylene resin was subjected to corona discharge treatment. The support was provided with a gelatin undercoat layer containing sodium dodecylbenzenesulfonate, and further, photographic constituting layers, from the first layer to the seventh layer, described below were coated in order to prepare a silver halide color photographic material Sample Nos. 101 to 112 shown below. The coating solution of each photographic constituting layer was prepared as described below.

Preparation of Coating Solution

Each coupler, color image stabilizer and ultraviolet absorber were dissolved in a solvent and ethyl acetate. The solution was emulsified and dispersed in a 10 wt % gelatin aqueous solution containing a surfactant by means of a high speed dissolver and water was added, thus an emulsified dispersion was prepared.

The above emulsified dispersion and high silver chloride emulsion were mixed and dissolved to prepare a coating solution having the composition described below.

As the gelatin hardening agent in each layer, 1-oxy-3,5-dichloro-s-triazine sodium salt was used. Further, Ab-1, Ab-2 and Ab-3 were added to each layer so that the total amount became 15.0 mg/m$^2$, 60.0 mg/m$^2$ and 5.0 mg/m$^2$, respectively.

(Ab-1) Preservative

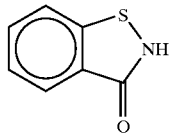

(Ab-2) Preservative

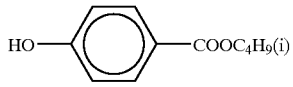

(Ab-3) Preservative

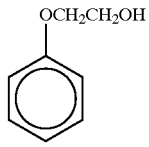

High Silver chloride emulsion used in each photosensitive layer was as follows.

Blue-Sensitive Emulsion Layer

The above prepared silver chloride tabular grain emulsion was used.

Green-Sensitive Emulsion Layer

Silver chlorobromide emulsion (a cubic form, a mixture in a ratio of 1/3 (silver mol ratio) of a large grain size emulsion having an average grain size of 0.45 μm and a small grain size emulsion having an average grain size of 0.35 μm, variation coefficients of the grain size distribution were 10% and 8%, respectively, emulsions of both sizes contained 0.4 mol % of silver bromide localized at a part of the grain surface and the remaining substrate was comprised of silver chloride was used. Sensitizing Dye 9 was added to the large grain size emulsion in an amount of $3.0\times10^{-4}$ mol per mol of the silver halide and to the small grain size emulsion in an amount of $3.6\times10^{-4}$ mol per mol of the silver halide, and Sensitizing Dye 10 was added to the large grain size emulsion in an amount of $4.0\times10^{-5}$ mol per mol of the silver halide and to the small grain size emulsion in an amount of $2.8\times10^{-4}$ mol per mol of the silver halide.

Sensitizing Dye 9

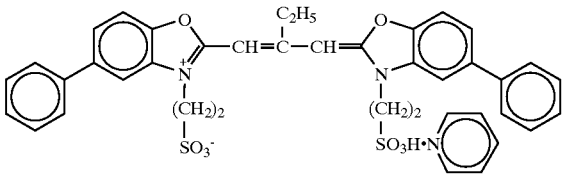

Sensitizing Dye 10

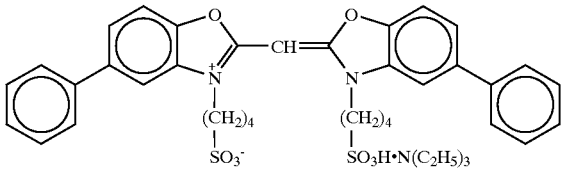

Red-Sensitive Emulsion Layer

Silver chlorobromide emulsion (a cubic form, a mixture in a ratio of 1/4 (silver mol ratio) of large grain size emulsion A having an average grain size of 0.50 μm and small grain size emulsion B having an average grain size of 0.41 μm, variation coefficients of the grain size distribution were 0.09 and 0.11, respectively, emulsions of both sizes contained 0.8 mol % of silver bromide localized at a part of the grain surface, and the remaining substrate was comprised of silver chloride was used. Sensitizing Dyes 11 and 12 were added to the large grain size emulsion each in an amount of $6.0\times10^{-5}$ mol per mol of the silver halide, and to the small grain size emulsion each in an amount of $9.0\times10^{-5}$ mol per mol of the silver halide.

Sensitizing Dye 11

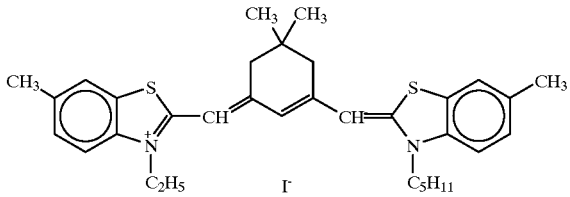

Sensitizing Dye 12

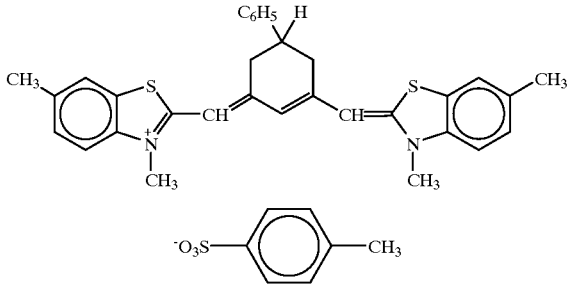

Further, the following Compound I was added to the red-sensitive emulsion layer in an amount of $2.6\times10^{-3}$ mol per mol of the silver halide.

Compound I

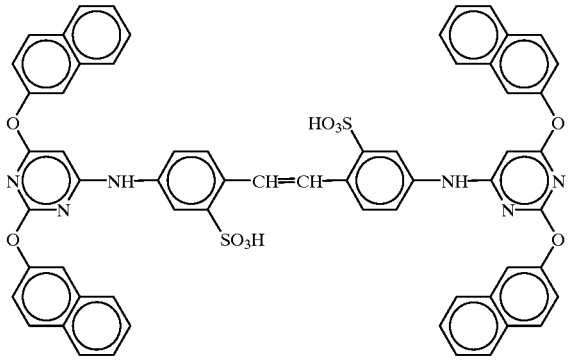

Further, 1-(3-methylureidophenyl)-5-mercaptotetrazole was added to the blue-sensitive emulsion layer, the green-sensitive emulsion layer and the red-sensitive emulsion layer in an amount of $3.3\times10^{-4}$ mol, $1.0\times10^{-3}$ mol and $5.9\times10^{-4}$ mol, respectively, per mol of the silver halide. Further, 1-(3-methylureidophenyl)-5-mercaptotetrazole was added to the second layer, the fourth layer, the sixth layer and the seventh layer in an amount of 0.2 mg/m$^2$, 0.2 mg/m$^2$, 0.6 mg/m$^2$ and 0.1 mg/m$^2$, respectively.

Copolymer of methacrylic acid and butyl acrylate (weight ratio: 1/1, average molecular weight: from 200,000 to 400,000) was added to the red-sensitive emulsion layer in an amount of 0.05 g/m$^2$. Further, disodium catechol-3,5-disulfonate was added to the second layer, the fourth layer and the sixth layer in an amount of 6 mg/m$^2$, 6 mg/m$^2$ and 18 mg/m$^2$, respectively.

Moreover, the following dyes were added to the emulsion layers for preventing irradiation (the numerals in parentheses represent the coating amount).

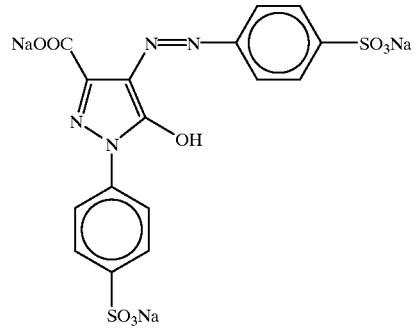

(1 mg/m$^2$)

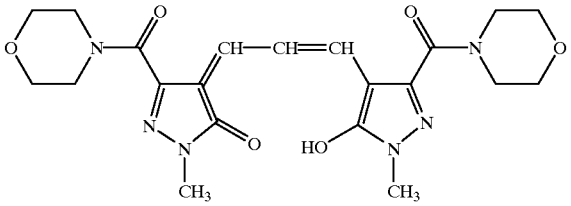

(5 mg/m$^2$)

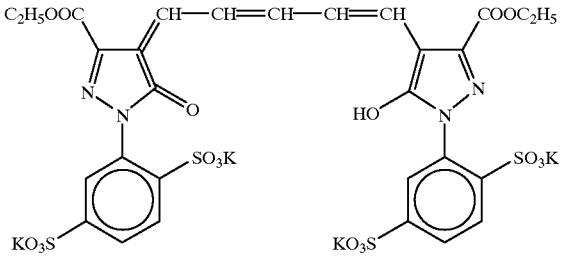

(6 mg/m$^2$)

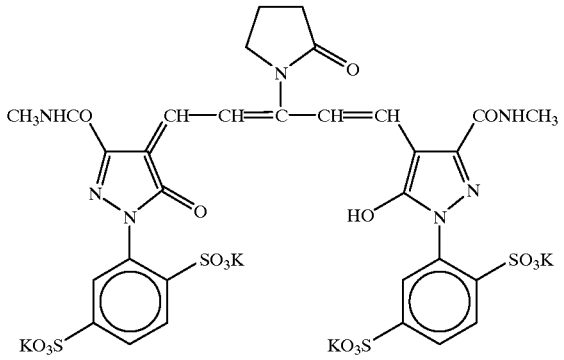

(16 mg/m$^2$)

Layer Constitution

The constitution of each layer is described below. The numeral represents the coating amount (g/m$^2$). The numeral for silver halide emulsion represents the coating amount in terms of silver.

Support

Polyethylene resin-laminated paper [a white pigment ($TiO_2$, content: 16 wt %, ZnO, content: 4 wt %), a brightening agent (13 mg/$m^2$ of 4,4'-bis(5-methylbenzoxazolyl) stilbene), and a blue dye (ultramarine) were added to the polyethylene resin of the first layer side].

| First Layer (blue-sensitive emulsion layer) | |
|---|---|
| Emulsion | 0.24 |
| Gelatin | 1.25 |
| Yellow Coupler (ExY) | 0.57 |
| Color Image Stabilizer (Cpd-1) | 0.07 |
| Color Image Stabilizer (Cpd-2) | 0.04 |
| Color Image Stabilizer (Cpd-3) | 0.07 |
| Color Image Stabilizer (Cpd-4) | 0.02 |
| Solvent (Solv-1) | 0.21 |

| Second Layer (color mixture preventing layer) | |
|---|---|
| Gelatin | 0.60 |
| Color Mixing Preventive (Mid-1) | 0.10 |
| Color Mixing Preventive (Mid-2) | 0.18 |
| Color Mixing Preventive (Mid-3) | 0.02 |
| Ultraviolet Absorber (UV-C) | 0.05 |
| Solvent (Solv-5) | 0.11 |

| Third Layer (green-sensitive emulsion layer) | |
|---|---|
| Emulsion | 0.14 |
| Gelatin | 0.73 |
| Magenta Coupler (ExM) | 0.15 |
| Ultraviolet Absorber (UV-A) | 0.05 |
| Color Image Stabilizer (Cpd-2) | 0.02 |
| Color Mixing Preventive (Cpd-3) | 0.008 |
| Color Image Stabilizer (Cpd-4) | 0.08 |
| Color Image Stabilizer (Cpd-5) | 0.02 |
| Color Image Stabilizer (Cpd-6) | 0.009 |
| Color Image Stabilizer (Cpd-7) | 0.0001 |
| Solvent (Solv-3) | 0.06 |
| Solvent (Solv-4) | 0.11 |
| Solvent (Solv-5) | 0.06 |

| Fourth Layer (color mixing preventing layer) | |
|---|---|
| Gelatin | 0.48 |
| Color Mixing Preventive (Mid-4) | 0.07 |
| Color Mixing Preventive (Mid-2) | 0.006 |
| Color Mixing Preventive (Mid-3) | 0.006 |
| Ultraviolet Absorber (UV-C) | 0.04 |
| Solvent (Solv-5) | 0.09 |

| Fifth Layer (red-sensitive emulsion layer) | |
|---|---|
| Emulsion | 0.12 |
| Gelatin | 0.59 |
| Cyan Coupler (ExC-1) | 0.13 |
| Cyan Coupler (ExC-2) | 0.03 |
| Color Mixing Preventive (Mid-3) | 0.01 |
| Color Image Stabilizer (Cpd-5) | 0.04 |
| Color Image Stabilizer (Cpd-8) | 0.19 |
| Color Image Stabilizer (Cpd-9) | 0.04 |
| Solvent (Solv-5) | 0.09 |

| Sixth Layer (ultraviolet absorbing layer) | |
|---|---|
| Gelatin | 0.32 |
| Ultraviolet Absorber (UV-C) | 0.42 |
| Solvent (Solv-7) | 0.08 |

-continued

| Seventh Layer (protective layer) | |
|---|---|
| Gelatin | 0.70 |
| Acryl-Modified Copolymer of Polyvinyl Alcohol (modification degree: 17%) | 0.04 |
| Liquid Paraffin | 0.01 |
| Surfactant (Cpd-13) | 0.01 |
| Polydimethylsiloxane | 0.01 |
| Silicon Dioxide | 0.003 |

(ExY) Yellow Coupler

A mixture (70/30 in the molar ratio) of

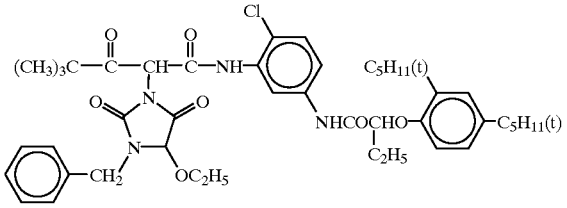

and

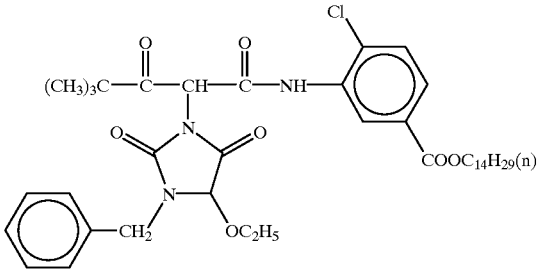

(ExM-1) Magenta Coupler

A mixture (40/40/20 in the molar ratio) of

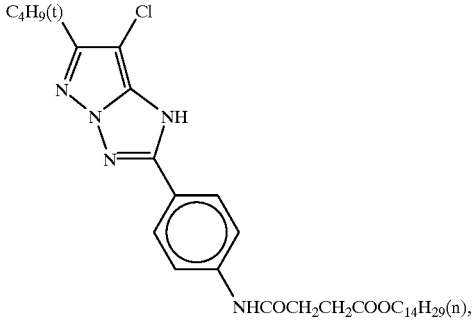

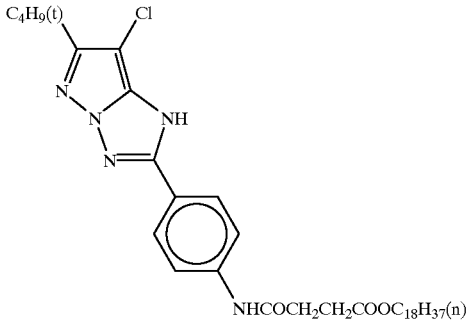

and

-continued

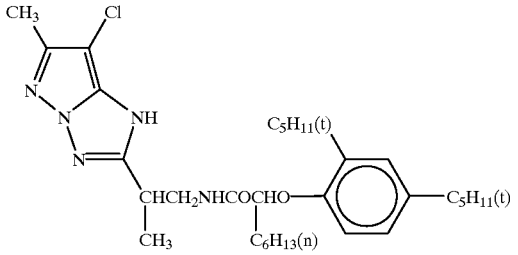

(ExC-1) Cyan Coupler

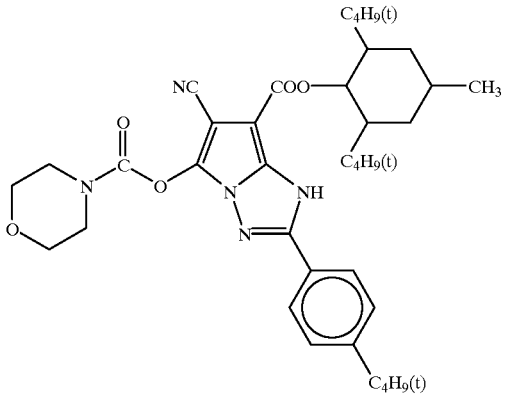

(ExC-2) Cyan Coupler

A mixture (50/25/25 in the molar ratio) of

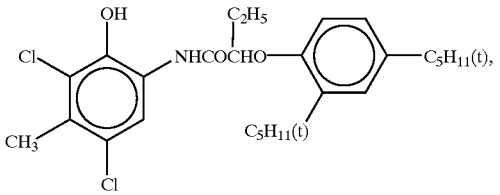

and

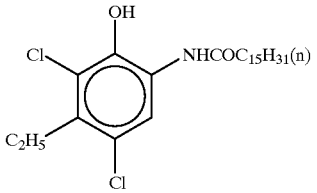

(Cpd-1) Color Image Stabilizer

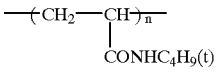

number average molecular weight: 60,000

(Cpd-2) Color Image Stabilizer

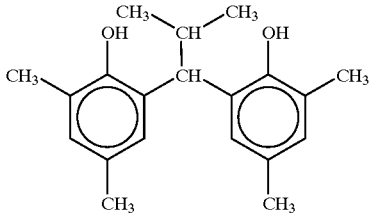

-continued (Cpd-3) Color Image Stabilizer

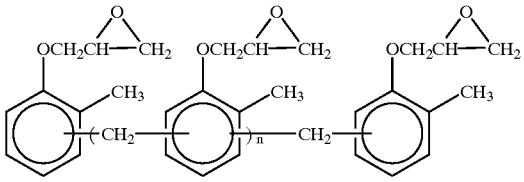

n = 7 to 8 (average value)

(Cpd-4) Color Image Stabilizer

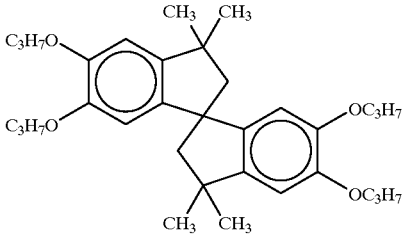

(Cpd-5) Color Image Stabilizer

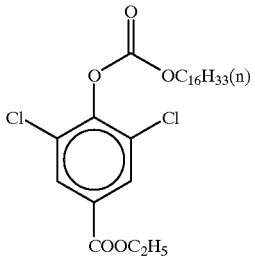

(Cpd-6) Color Image Stabilizer

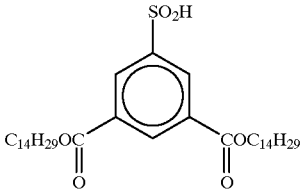

(Cpd-7) Color Image Stabilizer

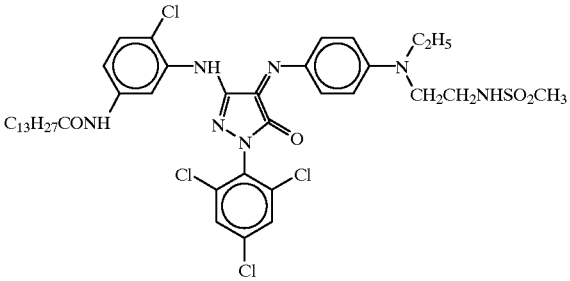

(Cpd-8) Color Image Stabilizer

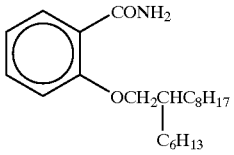

-continued (Cpd-9) Color Image Stabilizer

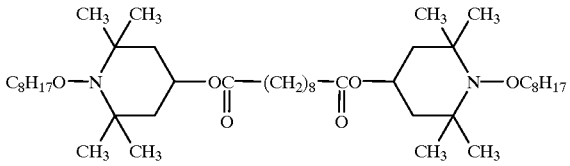

(Cpd-13) Surfactant

A mixture (7/3 in the molar ratio) of

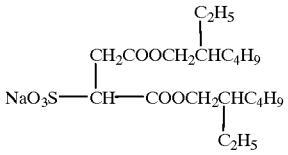

and

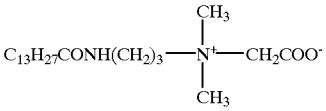

(Mid-1) Color Mixing Preventative

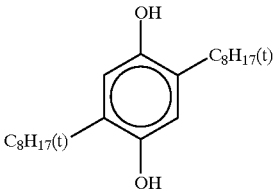

(Mid-2) Color Mixing Preventative

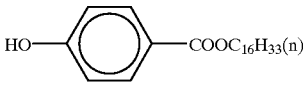

(Mid-3) Color Mixing Preventative

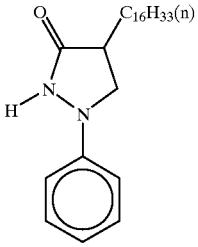

(Mid-4) Color Mixing Preventative

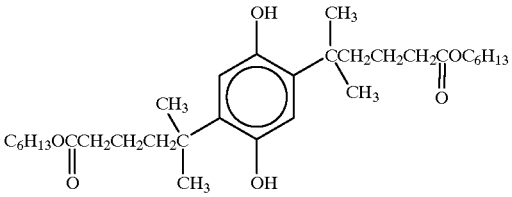

(Solv-1) Solvent

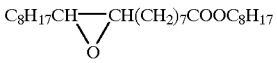

(Solv-3) Solvent

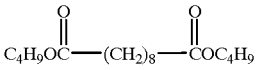

-continued (Solv-4) Solvent

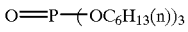

(Solv-5) Solvent

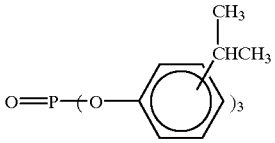

(Solv-7) Solvent

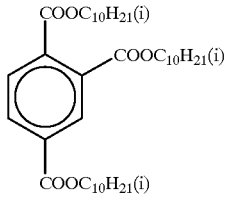

(UV-1) UV Absorber

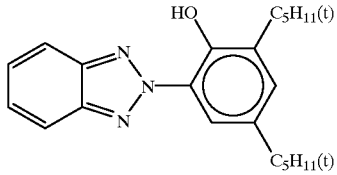

(UV-2) UV Absorber

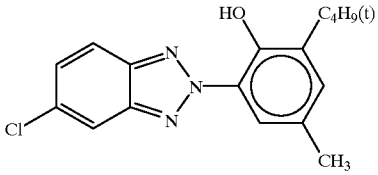

(UV-3) UV Absorber

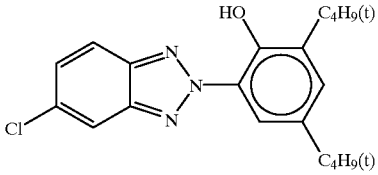

(UV-4) UV Absorber

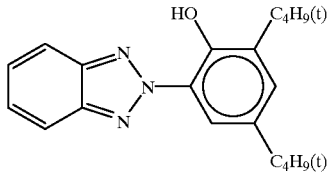

(UV-6) UV Absorber

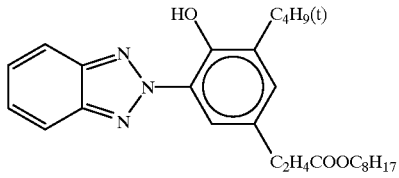

-continued (UV-7) UV Absorber

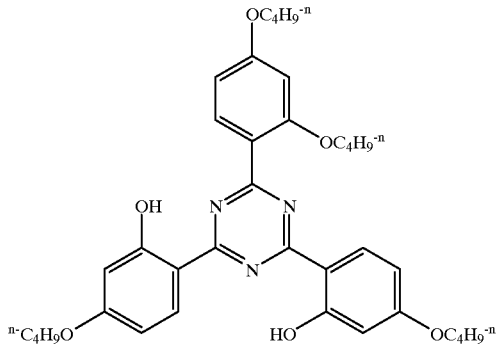

(UV-A)

A mixture of UV-1/UV-2/UV-3/UV-4 in the weight ratio of 4/2/2/3

(UV-C)

A mixture of UV-2/UV-3/UV-6/UV-7 in the weight ratio of 1/1/1/2

Thus, Coated Sample Nos. 101 to 112 were prepared.

Exposure

Gradation exposure by three color separation was performed with laser beams of three colors of B, G and R using the following exposing apparatus. At that time, laser output was corrected so that each sample could obtain appropriate improvement.

Exposure Apparatus

Three types of laser beams were used as light sources, that is, the wavelength of YAG solid state laser (oscillation wavelength: 946 nm) using a semiconductor laser GaAlAs (oscillation wavelength: 808.5 nm) as an excitation light source converted with SHG crystal of $LiNbO_3$ having reversal domain structure to 473 nm, the wavelength of $YVO_4$ solid state laser (oscillation wavelength: 1,064 nm) using a semiconductor laser GaAlAs (oscillation wavelength: 808.5 nm) as an excitation light source converted with SHG crystal of $LiNbO_3$ having reversal domain structure to 532 nm, and AlGaInP (oscillation wavelength: 680 nm, manufactured by Matsushita Electric Industrial Co., Ltd., Type No. LN9R20). Each of three laser beams was made to be able to successively scanning expose a color photographic paper transferring vertically to scanning direction by a polygonal mirror the intensity of which was modulated by AOM. For restraining the fluctuation of light amount due to the changes of temperature, the temperature of semiconductor laser was maintained constant using Peltier element. At this time, scanning exposure was performed at 600 dpi, and every beam diameter of B, G and R measured with a beam diameter meter (1180GP manufactured by Beam Scan Co., U.S.A.) was 65 $\mu$m (circular beams showing the difference in diameters in the main scanning direction/sub scanning direction of within 1%).

(Development Process, Dry to Dry: 70 Seconds)

Each of the above samples was subjected to color development processing using the following processing step and processing solutions.

| Step | Processing Temperature (° C.) | Processing Time (sec) | Replenishment Rate* (ml) | Tank Capacity (liter) |
|---|---|---|---|---|
| Color Development | 45 | 15 | 35 | 2 |
| Blixing | 40 | 15 | 38 | 1 |
| Rinsing (1) | 40 | 10 | — | 1 |
| Rinsing (2) | 40 | 10 | — | 1 |
| Rinsing (3) | 40 | 10 | 90 | 1 |
| Drying | 80 | 10 | — | — |

Rinsing was conducted in a 3-tank countercurrent system from rinsing (3) to rinsing (1). * Replenishing rate per $m^2$ of the photographic material Water of rinsing (3) tank was force fed to a reverse osmosis membrane, the penetrated water was charged to rinsing (3) tank, and concentrated water not passed the reverse osmotic membrane was fed back to rinsing (2) tank and used. For saving the crossover time, blades connecting each rinsing tank were equipped and samples were passed therebetween. A circulating processing solution was sprayed on samples in each processing step using spraying apparatus disclosed in JP-A-8-314088 at the spraying amount of from 4 to 6 l/min per one tank.

The composition of each processing solution was as follows.

| Color Developing Solution | Tank Solution | Replenisher |
|---|---|---|
| Water | 700 ml | 700 ml |
| Sodium Triisopropylnaphthalene (β) sulfonate | 0.1 g | 0.1 g |
| Ethylenediaminetetraacetic Acid | 3.0 g | 3.0 g |
| Disodium 1,2-dihydroxybenzene-4,6-disulfonate | 0.5 g | 0.5 g |
| Triethanolamine | 12.0 g | 12.0 g |
| Potassium Chloride | 15.8 g | — |
| Potassium Bromide | 0.04 g | — |
| Potassium Carbonate | 27.0 g | 27.0 g |
| Sodium Sulfite | 0.1 g | 0.1 g |
| Disodium-N,N-bis(sulfonatoethyl) hydroxylamine | 18.0 g | 18.0 g |
| N-Ethyl-N-(β-methanesulfonamidoethyl)-3-methyl-4-aminoaniline Sulfate | 8.0 g | 23.5 g |
| Sodium bis(2,4-disulfonatoethyl-1,3,5-triazin-6-yl)-diaminostilbene-2,2-disulfonato | 5.0 g | 6.0 g |
| Water to make | 1,000 ml | 1,000 ml |
| pH (25° C.) | 10.35 | 12.80 |

Blixing Solution

A blixing solution was prepared by mixing two components of a first replenisher and a second replenisher as follows.

| | Tank Solution | Replenisher (38 ml in total/$m^2$) |
|---|---|---|
| First replenisher | 260 ml | 18 ml |
| Second replenisher | 290 ml | 20 ml |
| Water to make | 1,000 ml | |
| pH (25° C.) | 5.0 | |

The compositions of the first replenisher and the second replenisher are as follows.

| First Replenisher | |
|---|---|
| Water | 150 ml |
| Ethylenebisguanidine Nitrate | 30 g |
| Ammonium Sulfite Monohydrate | 226 g |
| Ethylenediaminetetraacetic Acid | 7.5 g |
| Brightening Agent (Hakkol FWA-SF) (triazinyl aminostilbene, manufactured by Showa Chemicals Co., Ltd.) | 1.0 g |
| Ammonium Bromide | 30 g |
| Ammonium Thiosulfate (700 g/liter) | 340 ml |
| Water to make | 1,000 ml |
| pH (25° C.) | 5.82 |
| **Second Replenisher** | |
| Water | 140 ml |
| Ethylenediaminetetraacetic Acid | 11.0 g |
| Ammonium Ethylenediamine-tetraacetato Ferrate (III) | 384 g |
| Acetic Acid (50%) | 230 ml |
| Water to make | 1,000 ml |
| pH (25° C.) | 3.35 |

Rinsing Solution

Ion Exchange Water (each concentration of Ca and Mg is 3 ppm or less)

Processing for Comparison

CP45-X processing (dry to dry: 180 seconds, manufactured by Fuji Photo Film Co., Ltd.) was performed for comparison.

Each process of color development, blixing, rinsing (1) and rinsing (2) was 45 seconds.

The reflection density of each color sample processed was measured using a TCD type densitometer (manufactured by Fuji Photo Film Co., Ltd.). Sensitivity was obtained from the exposure amount required to give color density higher than fog density by 1.0. Blue sensitivity of each sample was expressed as a relative value with the sensitivity of Sample No. 101 processed for 180 seconds being 100. The results obtained are shown in Table 1 below.

It can be seen from the results in Table 1 that the emulsions according to the present invention are high speed and low in fog, in particular, the increase of fog density which is generated by rapid processing is a little and show low fog density.

Example 2

Preparation of Sample No. 201

A multilayer color photographic material was prepared as Sample No. 201 by coating each layer having the following composition on an undercoated cellulose triacetate film support having the thickness of 127 μm. The numeral corresponding to each component indicates the addition amount per $m^2$. The function of the compounds added is not limited to the use described.

| First Layer: Antihalation Layer | |
|---|---|
| Black Colloidal Silver | silver amount: 0.28 g |
| Gelatin | 2.20 g |
| Ultraviolet Absorber U-1 | 0.27 g |
| Ultraviolet Absorber U-3 | 0.08 g |
| Ultraviolet Absorber U-4 | 0.08 g |
| High Boiling Point Organic Solvent Oil-1 | 0.29 g |
| Coupler C-9 | 0.12 mg |
| **Second Layer: Intermediate Layer** | |
| Gelatin | 0.38 g |
| Compound Cpd-K | 5.0 mg |
| Ultraviolet Absorber U-2 | 3.0 mg |
| High Boiling Point Organic Solvent Oil-3 | 0.06 g |
| Dye D-4 | 10.0 mg |
| **Third Layer: Intermediate Layer** | |
| Yellow Colloidal Silver | silver amount: 0.007 g |
| Gelatin | 0.40 g |
| **Fourth Layer: First Red-Sensitive Emulsion Layer** | |
| Emulsion A | silver amount: 0.55 g |
| Emulsion B | silver amount: 0.23 g |
| Surface Fogged Fine Grain Silver Iodobromide Emulsion (average grain size: 0.11 μm) | silver amount: 0.07 g |
| Gelatin | 1.11 g |

TABLE 1

Results of Blue Sensitivity and Fog

| Sample No. | Sensitizing Dye (addition amount, mol/mol Ag) | | 180 Sec. Processing: Blue Sensitivity | 180 Sec. Processing: Fog | 70 Sec. Processing: Blue Sensitivity | 70 Sec. Processing: Fog | Remarks |
|---|---|---|---|---|---|---|---|
| 101 | Sen-1 ($6.0 \times 10^{-4}$) | — | 100 | 0.03 | 110 | 0.04 | Comparison |
| 102 | — | Sen-2 ($6.0 \times 10^{-4}$) | 130 | 0.05 | 139 | 0.07 | Comparison |
| 103 | Sen-1 ($3.6 \times 10^{-4}$) | Sen-2 ($2.4 \times 10^{-4}$) | 120 | 0.04 | 128 | 0.06 | Comparison |
| 104 | Sen-1 ($5.4 \times 10^{-4}$) | Sen-2 ($3.6 \times 10^{-4}$) | 135 | 0.05 | 142 | 0.08 | Comparison |
| 105 | Sen-1 ($5.4 \times 10^{-4}$) | IV-1 ($3.6 \times 10^{-4}$) | 130 | 0.03 | 138 | 0.06 | Comparison |
| 106 | Sen-1 ($5.4 \times 10^{-4}$) | IV-2 ($3.6 \times 10^{-4}$) | 136 | 0.04 | 145 | 0.07 | Comparison |
| 107 | III-1 ($5.4 \times 10^{-4}$) | Sen-2 ($3.6 \times 10^{-4}$) | 145 | 0.05 | 150 | 0.08 | Comparison |
| 108 | III-1 ($5.4 \times 10^{-4}$) | IV-1 ($3.6 \times 10^{-4}$) | 143 | 0.02 | 147 | 0.04 | Invention |
| 109 | III-1 ($5.4 \times 10^{-4}$) | IV-2 ($3.6 \times 10^{-4}$) | 144 | 0.03 | 149 | 0.04 | Invention |
| 110 | III-2 ($5.4 \times 10^{-4}$) | Sen-2 ($3.6 \times 10^{-4}$) | 140 | 0.04 | 146 | 0.07 | Comparison |
| 111 | III-2 ($5.4 \times 10^{-4}$) | IV-1 ($3.6 \times 10^{-4}$) | 138 | 0.02 | 144 | 0.03 | Invention |
| 112 | III-2 ($5.4 \times 10^{-4}$) | IV-2 ($3.6 \times 10^{-4}$) | 142 | 0.03 | 145 | 0.04 | Invention |

-continued

| | |
|---|---|
| Coupler C-1 | 0.04 g |
| Coupler C-2 | 0.09 g |
| Compound Cpd-A | 1.0 mg |
| Compound Cpd-E | 0.14 g |
| Compound Cpd-K | 2.0 mg |
| Compound Cpd-H | 4.4 mg |
| High Boiling Point Organic Solvent Oil-2 | 0.09 g |

Fifth Layer: Second Red-Sensitive Emulsion Layer

| | |
|---|---|
| Emulsion C | silver amount: 0.14 g |
| Emulsion D | silver amount: 0.28 g |
| Gelatin | 0.65 g |
| Coupler C-1 | 0.05 g |
| Coupler C-2 | 0.11 g |
| Compound Cpd-E | 0.10 g |
| High Boiling Point Organic Solvent Oil-2 | 0.09 g |

Sixth Layer: Third Red-Sensitive Emulsion Layer

| | |
|---|---|
| Emulsion E | silver amount: 0.50 g |
| Gelatin | 1.56 g |
| Coupler C-3 | 0.63 g |
| Compound Cpd-E | 0.11 g |
| Additive P-1 | 0.16 g |
| High Boiling Point Organic Solvent Oil-2 | 0.04 g |

Seventh Layer: Intermediate Layer

| | |
|---|---|
| Gelatin | 0.50 g |
| Compound Cpd-D | 0.04 g |
| High Boiling Point Organic Solvent Oil-3 | 0.08 g |

Eighth Layer: Intermediate Layer

| | |
|---|---|
| Yellow Colloidal Silver | silver amount: 0.01 g |
| Gelatin | 1.56 g |
| Compound Cpd-A | 0.12 g |
| Compound Cpd-I | 0.04 mg |
| Compound Cpd-J | 0.07 g |
| High Boiling Point Organic Solvent Oil-3 | 0.15 g |

Ninth Layer: First Green-Sensitive Emulsion Layer

| | |
|---|---|
| Emulsion F | silver amount: 0.42 g |
| Emulsion G | silver amount: 0.38 g |
| Emulsion H | silver amount: 0.32 g |
| Surface Fogged Core/Shell Type Fine Grain Silver Bromide Emulsion (average grain size: 0.11 μm) | silver amount: 0.08 g |
| Gelatin | 1.53 g |
| Coupler C-7 | 0.07 g |
| Coupler C-8 | 0.17 g |
| Compound Cpd-B | 0.30 mg |
| Compound Cpd-C | 2.00 mg |
| Compound Cpd-K | 3.0 mg |
| Polymer Latex P-2 | 0.02 g |
| High Boiling Point Organic Solvent Oil-2 | 0.10 g |

Tenth Layer: Second Green-Sensitive Emulsion Layer

| | |
|---|---|
| Emulsion I | silver amount: 0.16 g |
| Emulsion J | silver amount: 0.34 g |
| Gelatin | 0.75 g |
| Coupler C-4 | 0.20 g |
| Compound Cpd-B | 0.03 g |
| Polymer Latex P-2 | 0.01 g |
| High Boiling Point Organic Solvent Oil-2 | 0.01 g |

Eleventh Layer: Third Green-Sensitive Emulsion Layer

| | |
|---|---|
| Emulsion K | silver amount: 0.44 g |
| Gelatin | 0.91 g |
| Coupler C-4 | 0.34 g |
| Compound Cpd-B | 0.06 g |
| Polymer Latex P-2 | 0.01 g |
| High Boiling Point Organic Solvent Oil-2 | 0.02 g |

-continued

Twelfth Layer: Yellow Filter Layer

| | |
|---|---|
| Yellow Colloidal Silver | silver amount: 0.02 g |
| Gelatin | 0.73 g |
| Microcrystal Dispersion of Dye E-1 | 0.24 g |
| Compound Cpd-G | 0.02 g |
| Compound Cpd-J | 0.04 g |
| High Boiling Point Organic Solvent Oil-3 | 0.08 g |
| Polymer M-1 | 0.23 g |

Thirteenth Layer: First Blue-Sensitive Emulsion Layer

| | |
|---|---|
| Emulsion L | silver amount: 0.35 g |
| Gelatin | 0.55 g |
| Coupler C-5 | 0.20 g |
| Coupler C-6 | 4.00 g |
| Coupler C-10 | 0.02 g |
| Compound Cpd-E | 0.07 g |
| Compound Cpd-K | 0.03 mg |

Fourteenth Layer: Second Blue-Sensitive Emulsion Layer

| | |
|---|---|
| Emulsion M | silver amount: 0.06 g |
| Emulsion N | silver amount: 0.10 g |
| Gelatin | 0.75 g |
| Coupler C-5 | 0.35 g |
| Coupler C-6 | 5.00 g |
| Coupler C-10 | 0.30 g |
| Compound Cpd-E | 0.04 g |

Fifteenth Layer: Third Blue-Sensitive Emulsion Layer

| | |
|---|---|
| Emulsion O | silver amount: 0.20 g |
| Emulsion P | silver amount: 0.02 g |
| Gelatin | 2.40 g |
| Coupler C-6 | 0.09 g |
| Coupler C-10 | 0.90 g |
| Compound Cpd-E | 0.09 g |
| Compound Cpd-M | 0.05 mg |
| High Boiling Point Organic Solvent Oil-2 | 0.40 g |
| Additive P-2 | 0.10 g |

Sixteenth Layer: First Protective Layer

| | |
|---|---|
| Gelatin | 1.30 g |
| Ultraviolet Absorber U-1 | 0.10 g |
| Ultraviolet Absorber U-2 | 0.03 g |
| Ultraviolet Absorber U-5 | 0.20 g |
| Compound Cpd-F | 0.40 g |
| Compound Cpd-J | 0.06 g |
| Dye D-1 | 0.01 g |
| Dye D-2 | 0.01 g |
| Dye D-3 | 0.01 g |
| Dye D-5 | 0.01 g |
| High Boiling Point Organic Solvent Oil-2 | 0.37 g |

Seventeenth Layer: Second Protective Layer

| | |
|---|---|
| Fine Grain Silver Iodobromide Emulsion (average grain size: 0.06 μm, AgI content: 1 mol %) | silver amount: 0.05 g |
| Gelatin | 1.80 g |
| Compound Cpd-L | 0.8 mg |
| Polymethyl Methacrylate (average particle size: 1.5 μm) | 5.00 g |
| Copolymer of Methyl Methacrylate/Acrylic Acid in Proportion of 6/4 (average particle size: 1.5 μm) | 0.10 g |
| Silicone Oil SO-1 | 0.030 g |
| Surfactant W-2 | 0.030 g |

Further, Additives F-1 to F-11 were added to every emulsion layer in addition to the above components. Moreover, Gelatin Hardener H-1 and Surfactants W-1, W-3, W-4, W-5 and W-6 for coating and emulsifying were added to every layer in addition to the above components. In addition, phenol, 1,2-benzisothiazolin-3-one, 2-phenoxyethanol, phenethyl alcohol, p-hydroxybenzoic acid butyl ester were added as antiseptic and antibacterial agents. Photosensitive emulsions used in Sample No. 201 are shown in Table 2 below.

TABLE 2

| Emulsion | Equivalent-Sphere Diameter (μm) | Variation Coefficient of Equivalent-Circle Diameter (%) | Average Aspect Ratio of Entire Grains | Iodide Content (mol %) | Sensitizing Dye Kind | Sensitizing Dye Addition Amount ($\times 10^{-4}$mol/mol-Ag) | Sensitizing Dye Kind | Sensitizing Dye Addition Amount ($\times 10^{-4}$mol/mol-Ag) | Sensitizing Dye Kind | Sensitizing Dye Addition Amount ($\times 10^{-4}$mol/mol-Ag) |
|---|---|---|---|---|---|---|---|---|---|---|
| A | 0.20 | 16 | 1.6 | 4.0 | S-1 | 8.1 | | | S-3 | 0.3 |
| B | 0.25 | 15 | 3.0 | 4.0 | S-1 | 8.9 | | | S-3 | 0.3 |
| C | 0.22 | 14 | 2.5 | 4.0 | S-1 | 8.8 | S-2 | 0.2 | S-3 | 0.2 |
| D | 0.35 | 10 | 3.6 | 4.0 | S-1 | 9.8 | S-2 | 0.3 | S-3 | 0.2 |
| E | 0.49 | 16 | 5.0 | 2.0 | S-1 | 6.7 | S-2 | 0.5 | S-3 | 0.2 |
| F | 0.15 | 15 | 1.0 | 3.5 | S-4 | 15.1 | S-5 | 1.5 | | |
| G | 0.23 | 14 | 1.9 | 3.5 | S-4 | 10.4 | S-5 | 2.0 | | |
| H | 0.32 | 11 | 2.4 | 3.5 | S-4 | 7.5 | S-5 | 1.4 | | |
| I | 0.28 | 11 | 4.5 | 3.3 | S-4 | 7.7 | S-5 | 1.4 | | |
| J | 0.40 | 16 | 4.0 | 3.3 | S-4 | 7.2 | S-5 | 1.4 | | |
| K | 0.59 | 20 | 5.9 | 2.8 | S-4 | 6.4 | S-5 | 1.2 | | |
| L | 0.24 | 14 | 3.4 | 4.6 | S-6 | 6.5 | S-7 | 2.5 | | |
| M | 0.30 | 10 | 3.0 | 4.6 | S-6 | 6.2 | S-7 | 2.0 | | |
| N | 0.40 | 9 | 4.5 | 1.6 | S-6 | 5.6 | S-7 | 1.8 | | |
| O | 0.60 | 15 | 5.5 | 1.0 | S-6 | 4 | S-7 | 1.5 | | |
| P | 0.80 | 18 | 2.5 | 1.0 | S-6 | 3.4 | S-7 | 1.1 | | |

Note 1) All of the above emulsions were chemically sensitized using gold, sulfur and selenium.

Note 2) All of the above emulsions were added with sensitizing dyes before chemical sensitization.

Note 3) Appropriate amounts of Compounds F-5, F-7, F-8, F-9, F-10, F-11, F-12, F-13 and F-14 were respectively added to the above emulsions.

Note 4) Emulsions A, B, I and J comprise triple structure tabular grains having main planes comprising {100} planes and other emulsions having main planes comprising {111} planes.

Note 5) Emulsions A, B, E, F, I and P are emulsions whose internal sensitivities are higher than surface sensitivities.

Note 6) Emulsions E, I and P are emulsions comprising silver chloride grains epitaxially grown after chemical sensitization.

Note 7) Emulsions other than A, E and F comprise grains having 50 or more dislocation lines per one grain when observed by a transmission electron microscope.

Preparation of Dispersion of Organic Solid Dispersion Dye

Dye E-1 shown below was dispersed according to the following method. That is, water and 70 g of W-4 were added to 1,400 g of a wet cake of the dye containing 30% of water, and stirred to obtain a slurry having 30% dye concentration. In the next place, 1,700 ml of zirconia beads having an average diameter of 0.5 mm were filled in an ultravisco mill (UVM-2) manufactured by Imex Co., Ltd., the slurry was passed and the content was pulverized at a peripheral speed of about 10 m/sec and discharge amount of 0.5 l/min for 8 hours. Beads were removed by filtration and the resulting dispersion was heated at 90° C. for 10 hours for stabilization, then water and gelatin were added thereto to dilute the dispersion to a dye concentration of 3%. The average particle size of the obtained fine particles of the dye was 0.4 μm and the extent of distribution of particle sizes [(standard deviation of particle sizes)/(average particle size)×100] was 18%.

Preparation of Sample Nos. 200, 202 to 206

Sample Nos. 202 to 206 were prepared by replacing Sensitizing Dyes S-1 and S-2 in Emulsions A to E used in Sample No. 201 with equimolar amounts of the dyes as shown in Table 3 below, and Sample No. 200 was prepared by eliminating dyes. Each piece of the samples thus obtained was subjected to 20 CMS white light exposure for 1/100 sec. through a gray wedge, then processed by the following processing step, and sensitometry was performed. The cyan stain density of dye-free Sample No. 200 was subtracted from the cyan stain density of each piece of the samples after processing and residual color was evaluated. Measurement of the magenta stain density was performed using a densitometer Status A, a product of X-RITE Co.

C-1

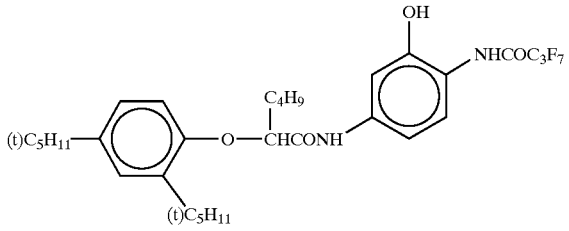

C-2

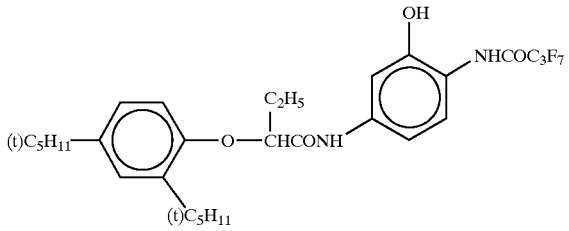

C-3

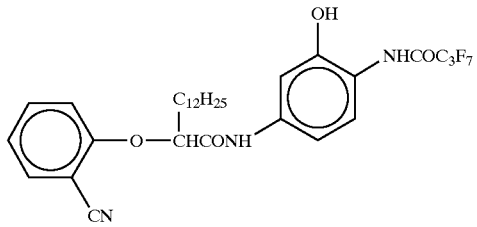

-continued
C-4
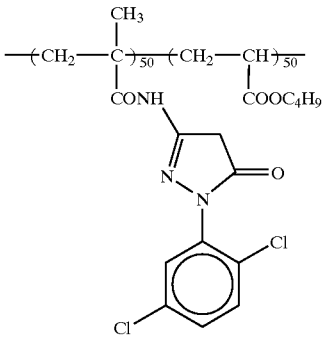
numerals indicate wt %
average molecular weight: about 25,000
C-5
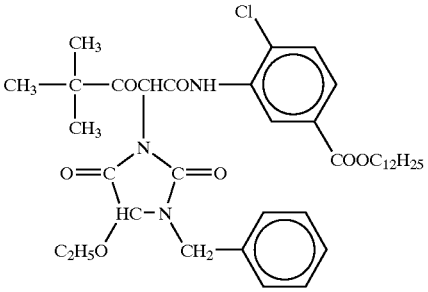
C-6
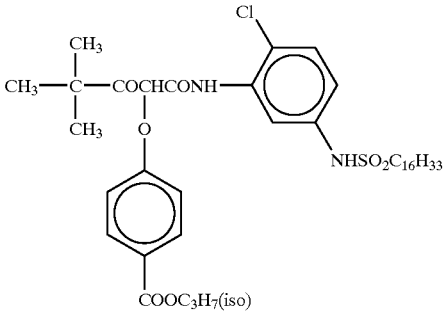
C-7
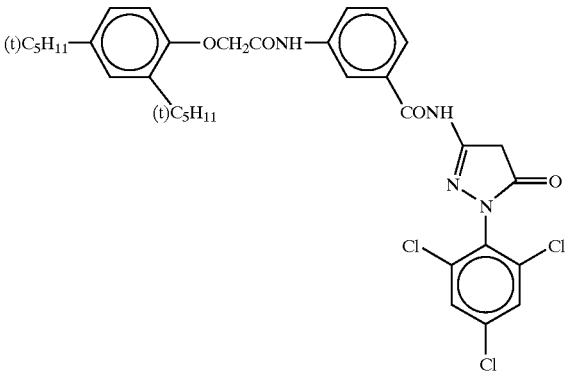
-continued
C-8
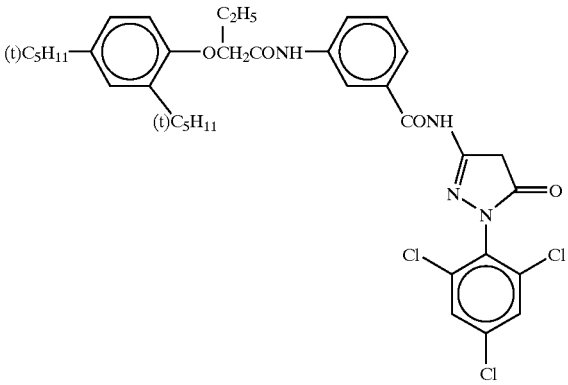
C-9
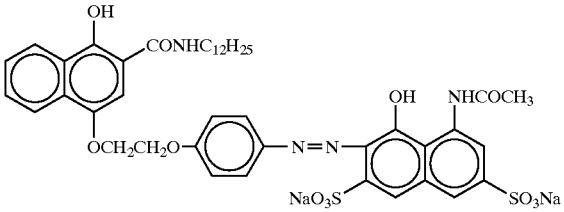
C-10
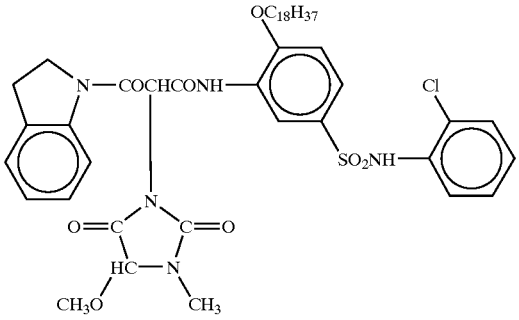
Oil-1
Dibutyl Phthalate
Oil-2
Tricresyl Phosphate
Oil-3
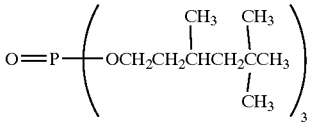
Cpd-A
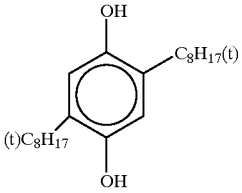

-continued
Cpd-B
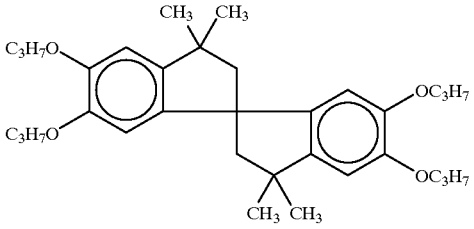
Cpd-C
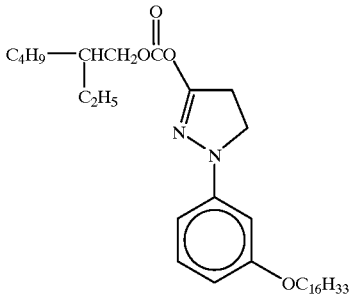
Cpd-D
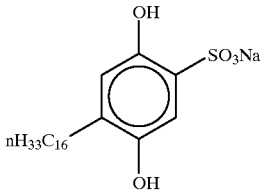
Cpd-E
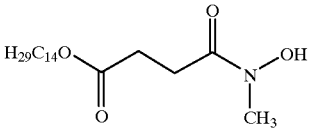
Cpd-F
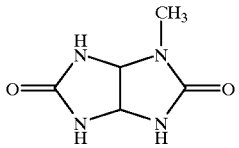
Cpd-G
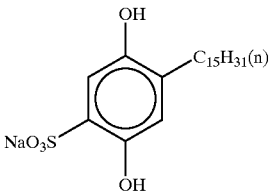
Cpd-H
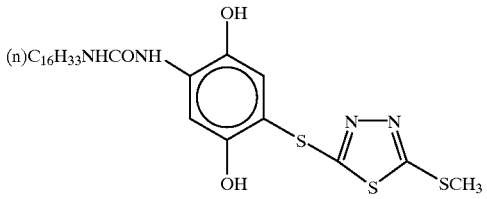
-continued
Cpd-I
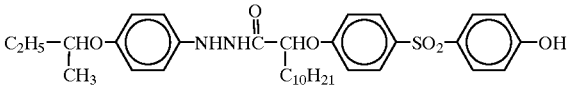
Cpd-K
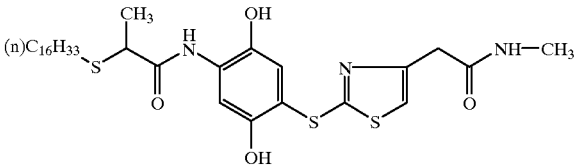
Cpd-J
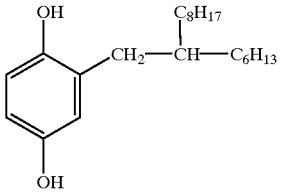
Cpd-L
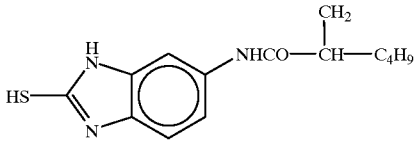
Cpd-M
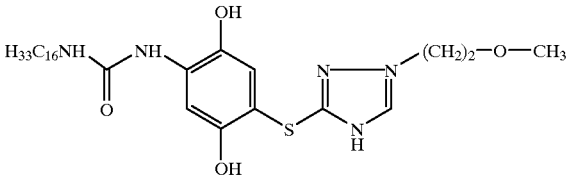
U-1
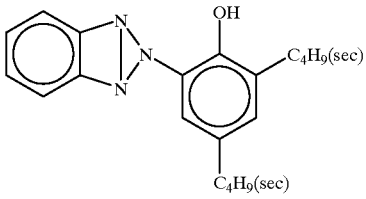
U-2
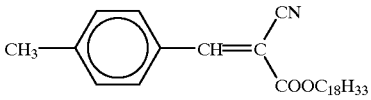
U-3
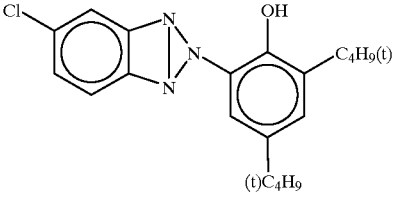

-continued
U-4
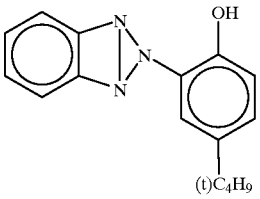
U-5
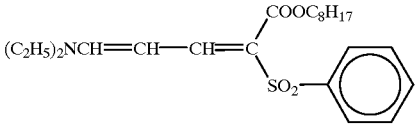
S-1
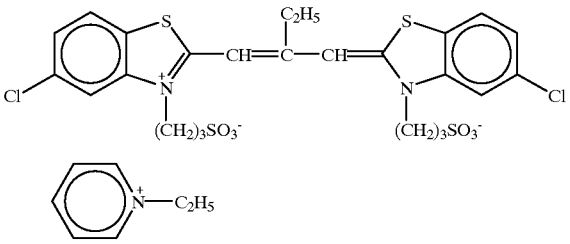
S-2
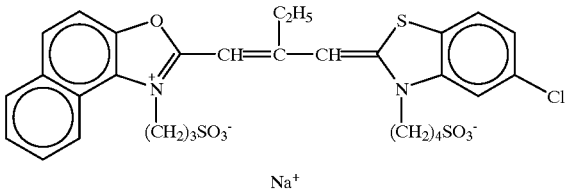
S-3
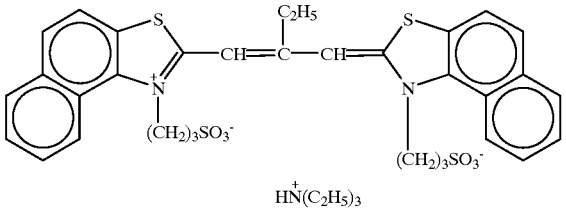
S-4
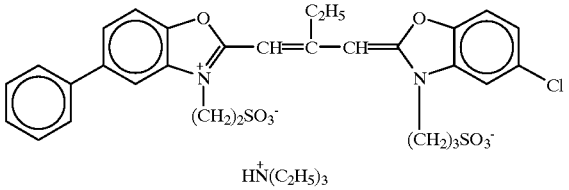
S-5
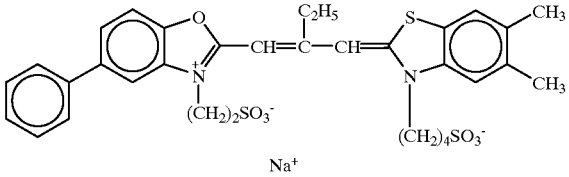
-continued
S-6
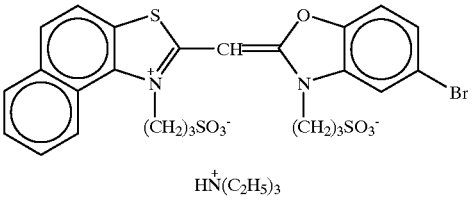
S-7
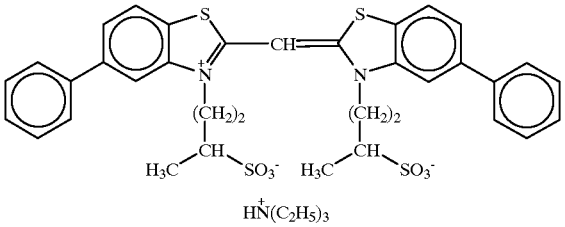
D-1
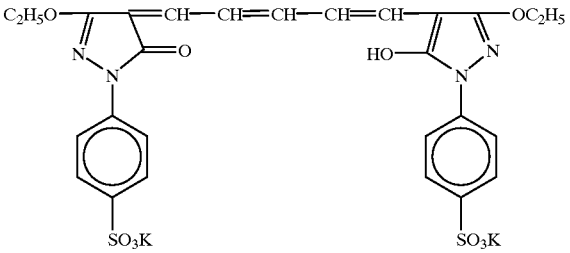
D-2
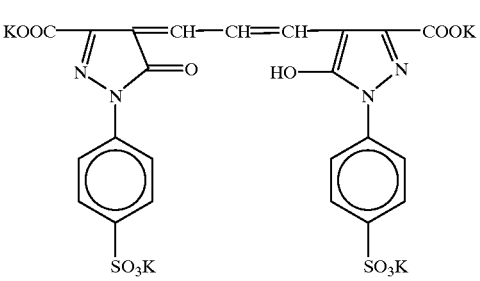
D-3
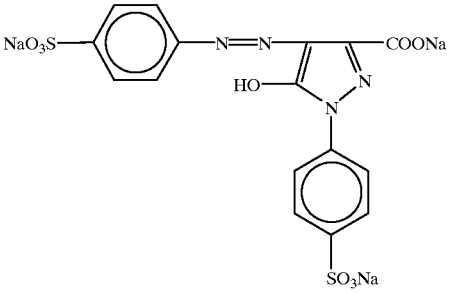

-continued
D-4
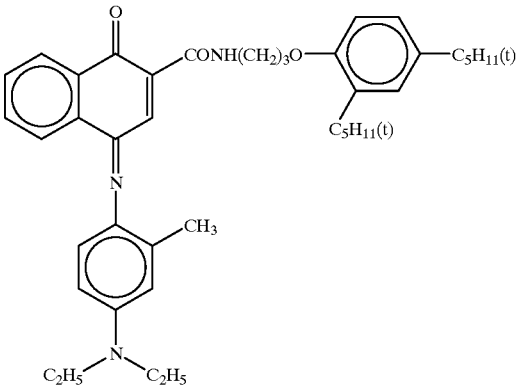
D-5
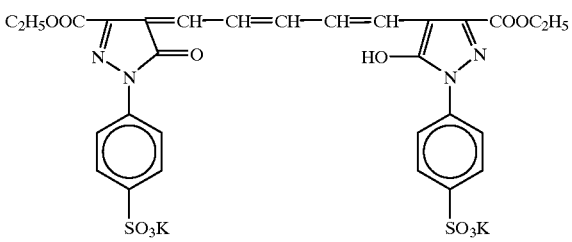
E-1
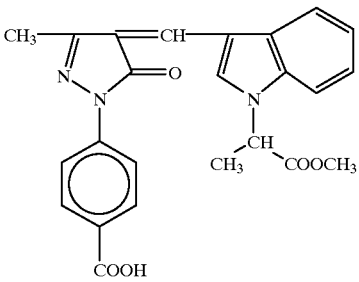
H-1
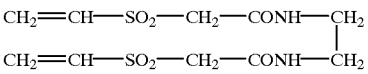
W-1
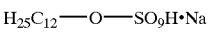
W-2
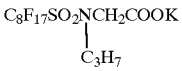
W-3
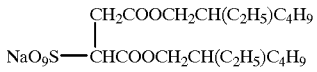
W-4
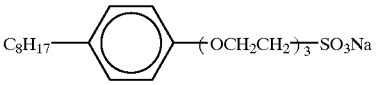
W-5
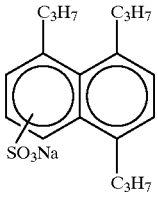
-continued
W-6
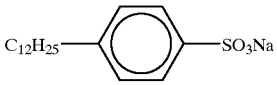
P-1
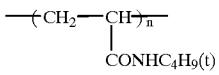
M-1
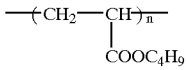
SO-1
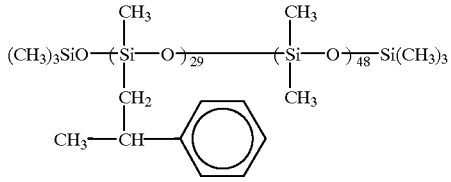
P-2 Polybutyl acrylate/acrylic acid copolymer in proportion of 95/5
F-1
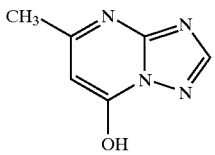
F-2
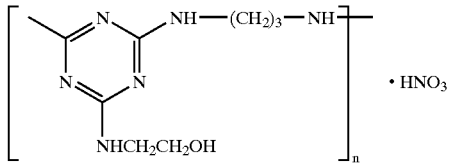
(n = 3 ~ 4)
F-3
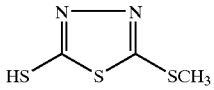
F-4
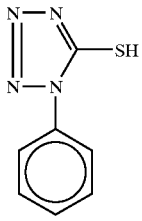
F-5
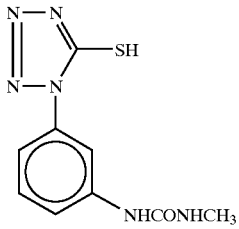

-continued

F-6

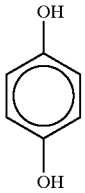

F-7

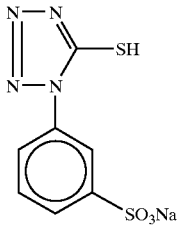

F-8

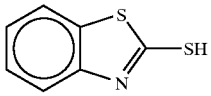

F-9

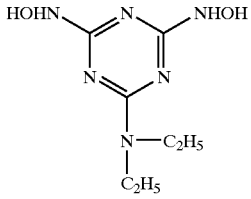

F-10

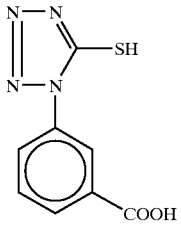

F-11

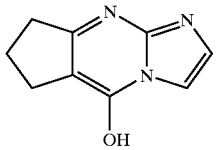

F-12

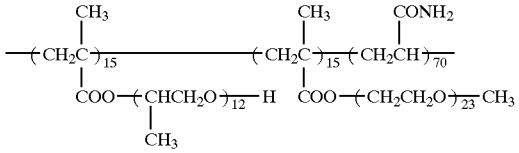

F-13

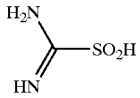

F-14

$K_2IrCl_6$

Processing

| Processing Step | Processing Time (min) | Processing Temperature (° C.) | Tank Capacity (liter) | Replenishing Rate (ml/m$^2$) |
|---|---|---|---|---|
| First Development | 6 | 38 | 12 | 2,200 |
| First Washing | 2 | 38 | 4 | 7,500 |
| Reversal | 2 | 38 | 4 | 1,100 |
| Color Development | 6 | 38 | 12 | 2,200 |
| Pre-bleaching | 2 | 38 | 4 | 1,100 |
| Bleaching | 6 | 38 | 2 | 220 |
| Fixing | 4 | 38 | 8 | 1,100 |
| Second Washing | 4 | 38 | 8 | 7,500 |
| Final Rinsing | 1 | 25 | 2 | 1,100 |

The composition of each processing solution used was as follows.

| | Tank Solution | Replenisher |
|---|---|---|
| First Developing Solution | | |
| Pentasodium Nitrilo-N,N,N-trimethylenephosphonate | 1.5 g | 1.5 g |
| Pentasodium Diethylenetriaminepentaacetate | 2.0 g | 2.0 g |
| Sodium Sulfite | 30 g | 30 g |
| Potassium Hydroquinonemonosulfonate | 20 g | 20 g |
| Potassium Carbonate | 15 g | 20 g |
| Sodium Bicarbonate | 12 g | 15 g |
| 1-Phenyl-4-methyl-4-hydroxymethyl-3-pyrazolidone | 1.5 g | 2.0 g |
| Potassium Bromide | 2.5 g | 1.4 g |
| Potassium Thiocyanate | 1.2 g | 1.2 g |
| Potassium Iodide | 2.0 mg | — |
| Diethylene Glycol | 13 g | 15 g |
| Water to make | 1,000 ml | 1,000 ml |
| pH (adjusted with sulfuric acid or potassium hydroxide) | 9.60 | 9.60 |
| Reversal Solution | | |
| Pentasodium Nitrilo-N,N,N-trimethylenephosphonate | 3.0 g | same as the tank solution |
| Stannous Chloride Dihydrate | 1.0 g | |
| p-Aminophenol | 0.1 g | |
| Sodium Hydroxide | 8 g | |
| Glacial Acetic Acid | 15 ml | |
| Water to make | 1,000 ml | |
| pH (adjusted with acetic acid or sodium hydroxide) | 6.00 | |
| Color Developing Solution | | |
| Pentasodium Nitrilo-N,N,N-trimethylenephosphonate | 2.0 g | 2.0 g |
| Sodium Sulfite | 7.0 g | 7.0 g |
| Trisodium Phosphate Dodecahydrate | 36 g | 36 g |
| Potassium Bromide | 1.0 g | — |
| Potassium Iodide | 90 mg | — |
| Sodium Hydroxide | 3.0 g | 3.0 g |
| Citrazinic Acid | 1.5 g | 1.5 g |
| N-Ethyl-N-(β-methanesulfonamidoethyl)-3-methyl-4-aminoaniline · 3/2 Sulfate · Monohydrate | 11 g | 11 g |
| 3,6-Dithiaoctane-1,8-diol | 1.0 g | 1.0 g |
| Water to make | 1,000 ml | 1,000 ml |
| pH (adjusted with sulfuric acid or potassium hydroxide) | 11.80 | 12.00 |

-continued

| | Tank Solution | Replenisher |
|---|---|---|
| Pre-bleaching Solution | | |
| Disodium Ethylenediamine-tetraacetate Dihydrate | 8.0 g | 8.0 g |
| Sodium Sulfite | 6.0 g | 8.0 g |
| 1-Thioglycerol | 0.4 g | 0.4 g |
| Sodium Bisulfite Addition Products of Formaldehyde | 30 g | 35 g |
| Water to make | 1,000 ml | 1,000 ml |
| pH (adjusted with acetic acid or sodium hydroxide) | 6.30 | 6.10 |
| Bleaching Solution | | |
| Disodium Ethylenediamine-tetraacetate Dihydrate | 2.0 g | 4.0 g |
| Ammonium Ethylenediamine-tetraacetato Ferrate (III) Dihydrate | 120 g | 240 g |
| Potassium Bromide | 100 g | 200 g |
| Ammonium Nitrate | 10 g | 20 g |
| Water to make | 1,000 ml | 1,000 ml |
| pH (adjusted with nitric acid or sodium hydroxide) | 5.70 | 5.50 |
| Fixing Solution | | |
| Ammonium Thiosulfate | 80 g | same as the tank solution |
| Sodium Sulfite | 5.0 g | same as the tank solution |
| Sodium Bisulfite | 5.0 g | same as the tank solution |
| Water to make | 1,000 ml | same as the tank solution |
| pH (adjusted with acetic acid or aqueous ammonia) | 6.60 | |
| Stabilizing Solution | | |
| 1,2-Benzisothiazolin-3-one | 0.02 g | 0.03 g |
| Polyoxyethylene-p-monononylphenyl Ether (average polymerization degree: 10) | 0.3 g | 0.3 g |
| Polymaleic Acid (average molecular weight: 2,000) | 0.1 g | 0.15 g |
| Water to make | 1,000 ml | 1,000 ml |
| pH | 7.0 | 7.0 |

The results of sensitometry and evaluation of residual color are shown in Table 3 below. Red light relative sensitivity was compared on the basis of the relative exposure amount giving the density larger than the minimum density by 1.0 with the sensitivity of Sample No. 201 being 100.

TABLE 3

Results of Red and Cyan Residual Color

| Sample No. | Sensitizing Dye | | Red Sensitivity | Cyan Residual Color | Remarks |
|---|---|---|---|---|---|
| 200 | None | None | — | 0 (control) | Blank |
| 201 | S-1 | S-2 | 100 | 0.072 | Comparison |
| 202 | S-1 | None | 79 | 0.055 | Comparison |
| 203 | S-1 | VI-1 | 102 | 0.062 | Comparison |
| 204 | V-1 | None | 83 | 0.018 | Comparison |
| 205 | V-1 | VI-1 | 115 | 0.024 | Invention |
| 206 | V-2 | VI-1 | 123 | 0.032 | Invention |

As is apparent from the results in Table 3 that photographic materials which are high speed and hardly generate residual color can be obtained using the compounds according to the present invention. Thus, high speed is compatible with freedom from residual color for the first time by using the constitution of the present invention.

Effects of the Invention

According to the constitution of the present invention, a silver halide photographic material which is high speed and hardly generates residual color can be obtained.

While the invention has been described in detail and with reference to specific examples thereof, it will be apparent to one skilled in the art that various changes and modifications can be made therein without departing from the spirit and scope thereof.

What is claimed is:

1. A silver halide color photographic material which comprises a support having provided thereon at least one emulsion layer containing the silver halide photographic emulsion which contains at least two different sensitizing dyes represented by the following formula (I):

$$\text{Dye-}((A)_r Q)_q (M)_m \qquad (I)$$

wherein Dye represents a cyanine dye moiety; A represents a linking group; Q represents a dissociable group; r represents 0 or 1; q represents an integer of 2 or more, provided that at least one Q represents —$SO_3H$ and at least one Q represents a dissociable group other than —$SO_3H$; M represents a counter ion; and m represents a number of 0 or more necessary to neutralize the electric charge in the molecule, and when m represents 2 or more, M's need not be the same.

2. The silver halide color photographic material as claimed in claim 1, wherein the dissociable group other than —$SO_3H$ is selected from the group consisting of —COOH, —$CONHSO_2R$, —$SO_2NHCOR$, —$SO_2NHSO_2R$, —CONHCOR, —$OSO_3H$, —$PO(OH)_2$, —$OPO(OH)_2$, —$B(OH)_2$, —$OB(OH)_2$, —ArOH, and —ArSH, wherein R represents an alkyl group, an aryl group, a heterocyclic group, an alkoxyl group, an aryloxy group, a heterocyclic oxy group, or an amino group, and Ar represents an arylene group.

3. The silver halide color photographic material as claimed in claim 1, wherein said at least two different sensitizing dyes are independently selected from the group consisting of monomethine cyanine dyes and trimethine cyanine dyes.

4. The silver halide color photographic material as claimed in claim 1, wherein said sensitizing dyes are represented by the following formula (II):

(II)

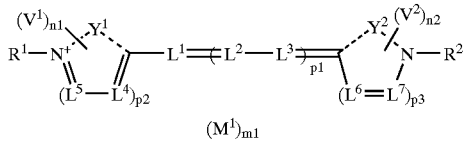

wherein $R^1$ and $R^2$ each represents a substituted alkyl, aryl or heterocyclic group, and $R^1$ is substituted with —$SO_3H$ and $R^2$ is substituted with a dissociable group other than —$SO_3H$; $Y^1$ and $Y^2$ each represents an atomic group necessary to form a 5- or 6-membered nitrogen-containing heterocyclic ring, and $Y^1$ and $Y^2$ may be condensed with other carbocyclic ring or heterocyclic ring; $V^1$ and $V^2$ each represents a substituent; $n^1$ and $n^2$ each represents an integer of 0 or more, and when $n^1$ and $n^2$each represent 2 or more, $V^1$ and $V^2$ may be the same as or different from each other; $L^1$, $L^2$, $L^3$, $L^4$, $L^5$, $L^6$ and $L^7$ each represents a methine group; $p^1$ represents 0, 1, 2 or 3, $p^2$ and $p^3$ each represents 0 or 1, and where $p^1$ represents 2 or 3, repeating $L^2$ and $L^3$ may be the same as or different from each other; $M^1$ represents a counter ion; and $m^1$ represents a number of 0 or more necessary to neutralize the electric charge in the molecule.

5. The silver halide color photographic material as claimed in claim 1, wherein at least one sensitizing dye is represented by the following formula (III) and at least one sensitizing dye is represented by formula (IV):

(III)

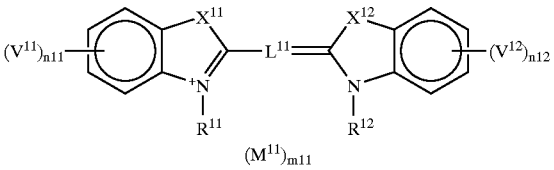

wherein $R^{11}$ and $R^{12}$ each represents a substituted alkyl, aryl or heterocyclic group, and $R^{11}$ is substituted with $—SO_3H$ and $R^{12}$ is substituted with a dissociable group other than $—SO_3H$; $X^{11}$ and $X^{12}$ each represents an oxygen atom, a sulfur atom, a selenium atom, $NR^{15}$, $CR^{16}R^{17}$, or $L^{13}=L^{14}$; $R^{15}$, $R^{16}$ and $R^{17}$ each represents a substituted or unsubstituted alkyl, aryl or heterocyclic group; $L^{13}$ and $L^{14}$ each represents a methine group; $V^{11}$ and $V^{12}$ each represents a substituent; $n^{11}$ and $n^{12}$ each represents an integer of 0 or more, and when $n^{11}$ and $n^{12}$ each represents 2 or more, $V^{11}$ and $V^{12}$ may be the same as or different from each other; $L^{11}$ represents a methine group; $M^{11}$ represents a counter ion; and $m^{11}$ represents a number of 0 or more necessary to neutralize the electric charge in the molecule;

(IV)

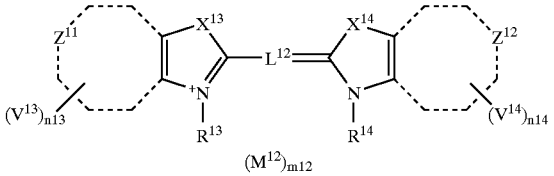

wherein $R^{13}$ and $R^{14}$ each represents a substituted alkyl, aryl or heterocyclic group, and at least one of $R^{13}$ and $R^{14}$ is substituted with $—SO_3H$ and the other is substituted with a dissociable group other than $—SO_3H$; $X^{13}$ and $X^{14}$ each represents an oxygen atom, a sulfur atom, a selenium atom, $NR^{18}$, $CR^{19}R^{20}$, or $L^{15}=L^{16}$; $R^{18}$, $R^{19}$ and $R^{20}$ each represents a substituted or unsubstituted alkyl, aryl or heterocyclic group; $L^{15}$ and $L^{16}$ each represents a methine group; $Z^{11}$ represents a benzene ring or a naphthalene ring; $Z^{12}$ represents a naphthalene ring; $V^{13}$ and $V^{14}$ each represents a substituent; $n^{13}$ and $n^{14}$ each represents an integer of 0 or more, and when $n^{13}$ and $n^{14}$ each represents 2 or more, $V^{13}$ and $V^{14}$ may be the same as or different from each other; $L^{12}$ represents a methine group; $M^{12}$ represents a counter ion; and $m^{12}$ represents a number of 0 or more necessary to neutralize the electric charge in the molecule.

6. The silver halide color photographic material as claimed in claim 5, wherein the dissociable group other than $—SO_3H$ is selected from the group consisting of —COOH, $—CONHSO_2R$, $—SO_2NHCOR$, $—SO_2NHSO_2R$, and —CONHCOR, wherein R represents an alkyl group, an aryl group, a heterocyclic group, an alkoxyl group, an aryloxy group, a heterocyclic oxy group, or an amino group.

7. The silver halide color photographic material as claimed in claim 1, wherein at least one sensitizing dye is represented by the following formula (V) and at least one sensitizing dye is represented by formula (VI):

(V)

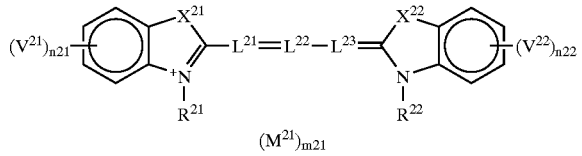

wherein $R^{21}$ and $R^{22}$ each represents a substituted alkyl, aryl or heterocyclic group, and at least one of $R^{21}$ and $R^{22}$ is substituted with $—SO_3H$ and the other is substituted with a dissociable group other than $—SO_3H$; $X^{21}$ and $X^{22}$ each represents an oxygen atom, a sulfur atom, a selenium atom, $NR^{25}$, $CR^{26}R^{27}$, or $L^{27}=L^{28}$; $R^{25}$, $R^{26}$ and $R^{27}$ each represents a substituted or unsubstituted alkyl, aryl or heterocyclic group; $L^{27}$ and $L^{28}$ each represents a methine group; $V^{21}$ and $V^{22}$ each represents a substituent; $n^{21}$ and $n^{22}$ each represents an integer of 0 or more, and when $n^{21}$ and $n^{22}$ each represents 2 or more, $V^{21}$ and $V^{22}$ may be the same as or different from each other; $L^{21}$, $L^{22}$ and $L^{23}$ each represents a methine group; $M^{21}$ represents a counter ion; and $m^{21}$ represents a number of 0 or more necessary to neutralize the electric charge in the molecule;

(VI)

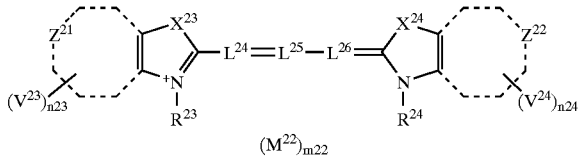

wherein $R^{23}$ and $R^{24}$ each represents a substituted alkyl, aryl or heterocyclic group, and at least one of $R^{23}$ and $R^{24}$ is substituted with $—SO_3H$ and the other is substituted with a dissociable group other than $—SO_3H$; $X^{23}$ and $X^{24}$ each represents an oxygen atom, a sulfur atom, a selenium atom, $NR^{28}$, $CR^{29}R^{30}$, or $L^{29}=L^{30}$; $R^{28}$, $R^{29}$ and $R^{30}$ each represents a substituted or unsubstituted alkyl, aryl or heterocyclic group; $L^{29}$ and $L^{30}$ each represents a methine group; $Z^{21}$ represents a benzene ring or a naphthalene ring; $Z^{22}$ represents a naphthalene ring; $V^{23}$ and $V^{24}$ each represents a substituent; $n^{23}$ and $n^{24}$ each represents an integer of 0 or more, and when $n^{23}$ and $n^{24}$ each represents 2 or more, $V^{23}$ and $V^{24}$ may be the same as or different from each other; $L^{24}$, $L^{25}$ and $L^{26}$ represents a methine group; $M^{22}$ represents a counter ion; and $m^{22}$ represents a number of 0 or more necessary to neutralize the electric charge in the molecule.

8. The silver halide color photographic material as claimed in claim 7, wherein the dissociable group other than $—SO_3H$ is selected from the group consisting of —COOH, $—CONHSO_2R$, $—SO_2NHCOR$, $—SO_2NHSO_2R$, and —CONHCOR, wherein R represents an alkyl group, an aryl group, a heterocyclic group, an alkoxyl group, an aryloxy group, a heterocyclic oxy group, or an amino group.

9. The silver halide color photographic material as claimed in claim 1, wherein 50% or more of the entire projected area of the silver halide grains in said emulsion is accounted for by tabular grains having an aspect ratio of 2 or more.

10. The silver halide color photographic material as claimed in claim 1, wherein said emulsion is chemically sensitized with a selenium sensitizer.

* * * * *